US006202910B1

(12) United States Patent
Swetish

(10) Patent No.: US 6,202,910 B1
(45) Date of Patent: Mar. 20, 2001

(54) RECEPTACLE COMPRESSION SYSTEM

(75) Inventor: Thomas R. Swetish, Racine, WI (US)

(73) Assignee: Johnson Outdoors Inc., Sturtevant, WI (US)

( * ) Notice: Subject to any disclaimer, the term of this patent is extended or adjusted under 35 U.S.C. 154(b) by 0 days.

(21) Appl. No.: 09/307,652

(22) Filed: May 7, 1999

Related U.S. Application Data

(63) Continuation-in-part of application No. 08/990,139, filed on Dec. 12, 1997.

(51) Int. Cl.[7] ..... A45F 3/04

(52) U.S. Cl. ..... 224/627; 224/103; 224/104; 224/580; 224/629; 224/650; 224/651

(58) Field of Search ..... 224/650, 627, 224/628, 629, 579, 580, 153, 651; 190/111, 112, 103, 104, 105; 383/2

(56) References Cited

U.S. PATENT DOCUMENTS

| | | | | |
|---|---|---|---|---|
| D. 339,225 | | 9/1993 | Zel . | |
| 1,636,838 | * | 7/1927 | Roser | 190/103 |
| 1,712,448 | * | 5/1929 | Eckhardt | 190/103 |
| 1,806,246 | * | 5/1931 | Feldman et al. | 190/103 |
| 2,407,787 | | 9/1946 | Kernahan . | |
| 2,792,980 | | 5/1957 | Brown . | |
| 3,019,952 | * | 2/1962 | Brewster | 224/579 X |
| 3,563,431 | | 2/1971 | Pletz . | |
| 3,797,718 | | 3/1974 | Plant . | |
| 4,331,272 | | 5/1982 | Ward . | |
| 4,491,258 | | 1/1985 | Jones . | |
| 4,506,769 | * | 3/1985 | Franco et al. | 224/579 X |

(List continued on next page.)

FOREIGN PATENT DOCUMENTS

| | | | | |
|---|---|---|---|---|
| 580515 | * | 9/1946 | (GB) | 190/103 |

OTHER PUBLICATIONS

1 Sheet from JWA catalog entitled "Duffel Bags".

Catalog entitled: Dealer Workbook 1991–92 by Gregory (25 pages) ; date unknown.

Catalog entitled; Osprey Packs 1997 by Osprey Packs, Dolores; CO; date unknown.

*Primary Examiner*—Gregory M. Vidovich
*Assistant Examiner*—Maerena W. Brevard
(74) *Attorney, Agent, or Firm*—Foley & Lardner

(57) ABSTRACT

A receptacle compression system includes a receptacle enclosing an internal volume. The receptacle includes the bottom panel having first and second opposite ends and first and second opposite sides and a top panel opposite the bottom panel. The top panel includes an opening therethrough. The receptacle further includes first and second side panels coupled to the first and second sides of the bottom panel, respectively, and extending towards the top panel. The first and second side panels each have a rigid perimeter extending from the bottom panel. The receptacle compression system further includes first and second compression straps. The first compression strap is connected to one of the first side panel and the second side panel and is configured to extend across the opening so as to be connected to the other of the first side panel and the second side panel. The second compression strap is connected to one of the first side panel and the second side panel and is configured to extend across the opening so as to be connected to the other of the first side panel and the second side panel. In one exemplary embodiment, the first and second side panels include first and second perimeters, wherein the first compression strap is coupled to one of the first perimeter and the second perimeter and is configured to be releasably coupled to the receptacle proximate of the bottom panel and wherein the second compression strap is coupled to one of the first perimeter and the second perimeter and is configured to be releasably coupled to the receptacle proximate one of the second side and the first side, respectively, of the bottom panel.

42 Claims, 12 Drawing Sheets

U.S. PATENT DOCUMENTS

| | | | | |
|---|---|---|---|---|
| 4,593,841 | * | 6/1986 | Lange | 224/579 X |
| 4,655,343 | | 4/1987 | Lane et al. . | |
| 4,752,263 | | 6/1988 | Pritchard et al. . | |
| 4,805,749 | | 2/1989 | Gerch . | |
| 4,844,307 | | 7/1989 | Rutledge . | |
| 4,884,731 | | 12/1989 | Sibley . | |
| 4,919,240 | * | 4/1990 | Tobias | 190/103 |
| 5,114,059 | | 5/1992 | Thatcher . | |
| 5,125,547 | | 6/1992 | Russell . | |
| 5,240,159 | | 8/1993 | Gregory . | |
| 5,538,169 | | 7/1996 | Moore . | |
| 5,570,824 | | 11/1996 | Lyon et al. . | |

* cited by examiner

FIG. 1
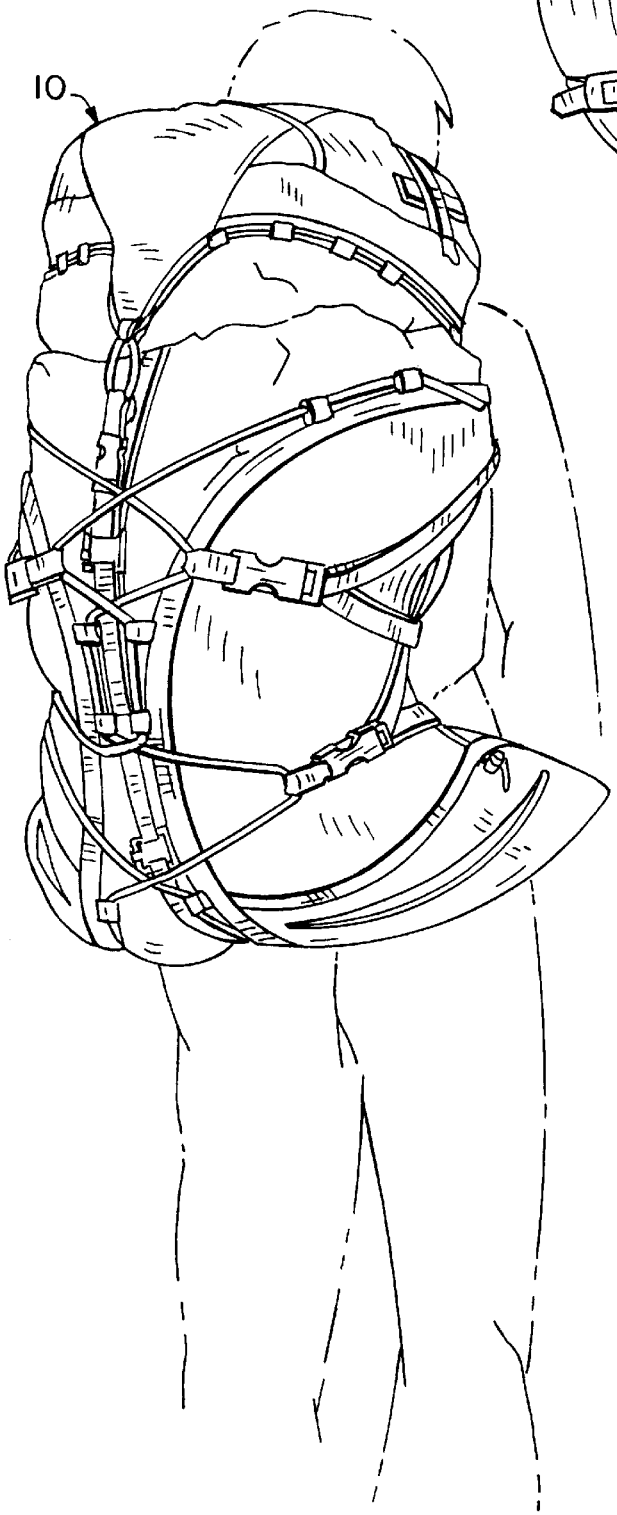
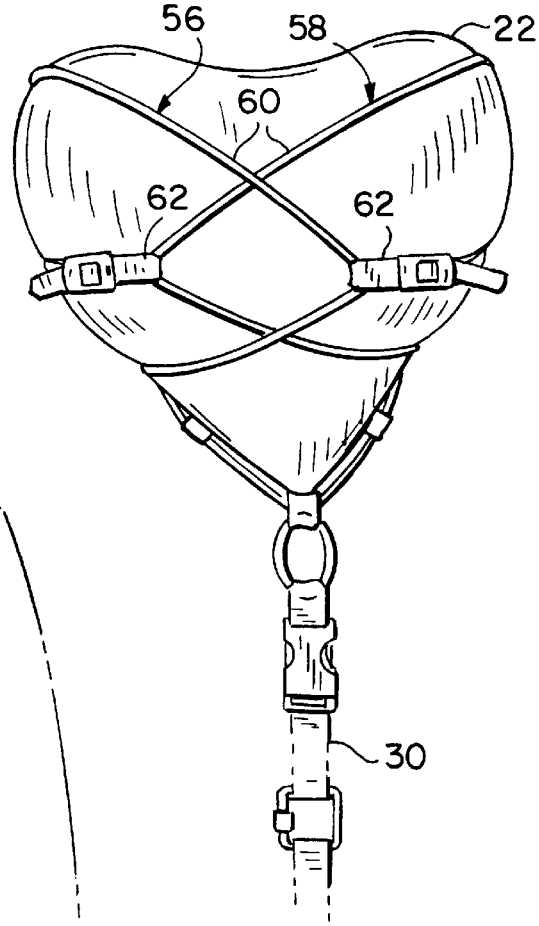
FIG. 5

RECEPTACLE COMPRESSION SYSTEM

RELATED APPLICATIONS

The present application is Continuation-In-Part of U.S. Patent Application Ser. No. 08/990,139 filed on Dec. 12, 1997 and entitled PACK COMPRESSION SYSTEM. The present application claims priority from U.S. patent application Ser. No. 08/990,139 under 35 U.S.C. Sec. 120.

FIELD OF THE INVENTION

The present invention relates generally to receptacles for containing and carrying various articles. In particular, the present invention relates to a receptacle compression system for loading, accessing, and compressing items within an internal volume of a receptacle.

BACKGROUND OF THE INVENTION

Receptacles come in a variety of forms, shapes, and sizes for containing, storing, and carrying a multitude of different items. Some receptacles, such as back packs, are configured to be supported by a user's shoulders adjacent to the user's back in a generally vertical orientation. Other receptacles, such as, duffel bags, gym bags, and the like, are configured to be manually carried at the user's side in a generally horizontal orientation.

Packs, such as, back packs, are well-known and are used for storing and carrying a wide-range of objects during such activities as camping, hiking, and trekking. Packs typically include a plurality of panels which define an internal storage volume. The internal storage volume is typically accessed through a top opening (hereinafter referred to as a top-loading pack), through an opening extending around and along a side of the pack (hereinafter referred to as a side-loading pack), or through an opening extending along a front panel of the pack opposite the user's back (hereinafter referred to as a panel-loading pack). The openings of each of the top-loading pack, side-loading pack, and panel-loading packs are conventionally closed by a zipper mechanism. In situations where the pack is over-filled, the zipper mechanism closing the openings frequently fail as a result of the stress placed upon it.

Top-loading packs require the user to load the internal storage volume through an opening defined on a top of the pack. As a result, objects loaded into the internal storage volume tend to settle towards the bottom of the pack in misalignment with the pack's center of gravity. Because the objects stored in the internal storage volume are loaded from the bottom up, it is often extremely difficult to access those objects stored at the bottom of the pack's internal storage volume.

To provide improved accessibility to objects stored in the pack, panel-loading packs and side-loading packs have been developed. Although panel-loading packs provide improved accessibility as compared to top-loading packs, the size of the openings of panel loading packs must be kept relatively small to minimize the stress placed upon the zipper mechanism when the pack is overfilled to prevent zipper failure. As a result, panel-loading packs still fail to provide complete access to the internal storage volume along the longitudinal length of the pack.

With side-loading packs, the entire front panel as well as a portion of the side panels of the pack are opened away from the back panel to access the entire length of the pack. As compared to top and panel-loading packs, side-loading packs place even greater stress on the zipper mechanism.

Because the zipper mechanism extends along the sides of the pack, the forces due to over-packing of items between the front panel and the back panel are transferred directly to the zipper extending along the sides of the pack. As a result, the zipper mechanisms of side-loading packs are even more difficult to close and hence, are even more susceptible to failure. Thus, over-filling the pack often results in the zipper mechanisms failing. At the same time, if the packs are not filled to capacity, loosely packed items in the internal storage volume will once again settle towards the bottom in misalignment with the user's center of gravity.

To prevent the settling of items within the internal storage volume, many side-loading and panel-loading packs are additionally provided with compression straps or compression mechanisms to compress and hold the items in place within the internal storage volume of the pack. These compression straps typically extend between the front and back and along opposite sides of the pack to compress the front panel perpendicularly towards the back panel of the pack. Although the compression straps or mechanisms may prevent items from settling towards the bottom of the pack, the compression straps pull opposite sides of the zipper mechanisms away from one another to increase the stress on the zipper and correspondingly increase the probability of the zipper failing. In addition, the compression straps do not inwardly compress the sides of the pack toward the centerline of the pack.

Manually-carried horizontal receptacles, such as, duffel bags, gym bags, overnight bags, and the like, have many of the same disadvantages associated with vertical receptacles, such as, back packs. Conventionally-known horizontal receptacles typically include a bottom panel that is generally configured to be placed upon a horizontal support surface when the receptacle is not being carried, a top panel opposite the bottom panel, and a multitude of side panels extending between the bottom panel and the top panel. The top panel typically includes an opening that is closed by one or more zippers. Most horizontal receptacles also include a multitude of additional pockets formed in the side panels.

Similar to vertical receptacles, horizontal receptacles also encounter various problems when underfilled or overfilled. When underfilled, items contained within the receptacle shift and can become disorganized. Moreover, when under filled, the receptacle occupies an unnecessary large volume of space. As a result, the horizontal receptacle may be extremely difficult to insert into storage spaces having small openings, such as, lockers. Insertion of the horizontal receptacle through such small openings often results in the excess protruding panels of the receptacle becoming caught upon walls, hooks, or other protruding surfaces of the storage space. This often leads to the receptacle becoming torn or otherwise damaged.

When overfilled, the panels extending between the bottom panel and the top panel spread apart to place a great amount of stress upon the zipper or other closing mechanism closing the opening. As a result, the closing mechanism or zipper frequently fails. Consequently, the opening can no longer be closed, and the horizontal receptacle is irreparably damaged.

As a result, there is a continuing need for vertical and horizontal receptacles having an internal storage volume that is completely accessible, that can be easily closed when full, and that can be fully compressed without increasing stress on the mechanisms used to close the internal storage volume of the receptacle.

SUMMARY OF THE INVENTION

The present invention is directed to the receptacle compression system including a receptacle, first and second side panels and first and second compression straps. The receptacle encloses an internal volume and includes a bottom panel and a top panel. The bottom panel has first and second opposite ends and first and second opposite sides. The top panel extends opposite the bottom panel and includes an opening therethrough. The first and second side panels are coupled to the first and second sides of the bottom panel, respectively, and extend towards the top panel. The first and second side panels each have a rigid perimeter extending from the bottom panel. The first compression strap is connected to one of the first side panel and the second side panel and is configured to extend across the opening to be connected to the other of the first side panel and the second side panel. The second compression strap is connected to one of the first side panel and the second side panel and is configured to extend across the opening to be connected to the other of the first side panel and the second side panel.

The present invention is also directed to a receptacle compression system which includes a receptacle, first and second panels, and first and second compression mechanisms. The receptacle encloses an internal volume and includes a bottom panel and a top panel. The bottom panel has first and second opposite ends and first and second opposite sides. The top panel includes an opening to access the internal volume. The first panel extends between the first and second opposite ends along a first side of the internal volume. The second panel extends between the first and second opposite ends along a second side of the internal volume. The first panel includes the first perimeter and is coupled proximate to the bottom panel at the first side so as to extend towards the top panel. The second panel includes a second perimeter and is coupled to the bottom panel at the second side so as to extend towards the top panel. The first compression mechanism is coupled to one of the first perimeter and second perimeter and is configured to be releasably coupled to the receptacle proximate one of the second side and the first side, respectively, of the bottom panel to compress said one of the first panel and the second panel over the internal volume and towards and opposite side of the internal volume. The second compression mechanism is coupled to one of the first perimeter and the second perimeter and is configured to be releasably coupled to the receptacle proximate one of the second side and the first side, respectively, of the bottom panel to compress said one of the first panel and the second panel over the internal volume and towards an opposite side of the internal volume.

The present invention also provides a receptacle compression system including a receptacle, first and second side panels, first and second handles, and first and second compression straps. The receptacles encloses an internal volume and includes a bottom panel and a top panel. The bottom panel has first and second opposite ends and first and second opposite sides. The top panel extends opposite the bottom panel and includes an opening therethrough. The first and second side panels are coupled to the first and second sides of the bottom panel, respectively, and extend towards the top panel. The first and second side panels each have a perimeter extending from the bottom panel. The first and second handles are coupled to the first and second side panels, respectively. The first compression strap is coupled to the first side panel at a plurality of locations along the perimeter of the first side panel. The second compression strap is connected to the second panel at a plurality of locations along the perimeter of the second side panel. The first side panel is configured to extend across the opening and to be connected to the second panel. The second panel is configured to extend across the opening and to be connected to the first side panel while the second compression strap is configured to extend across the opening to be connected to the first panel.

BRIEF DESCRIPTION OF THE DRAWINGS

FIG. 1 is a front perspective view of a pack compression system having a main pack and an auxiliary pack supported on a user's back.

FIG. 5 is a top elevational view of the auxiliary pack.

DETAILED DESCRIPTION OF THE PREFERRED EMBODIMENTS

Figure 2:
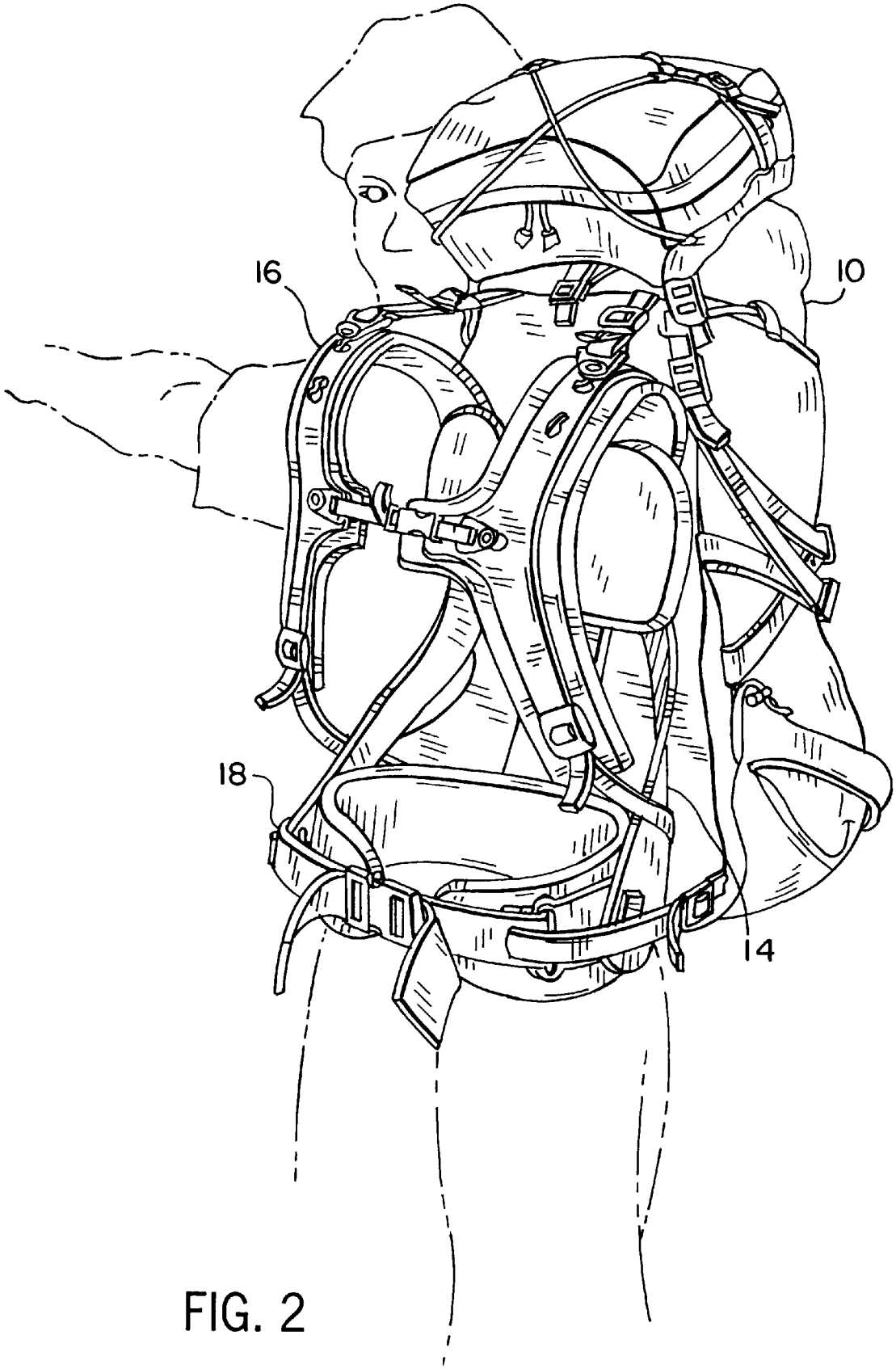
FIG. 2 is a rear perspective view of the pack compression system supported on a user's back.

FIGS. 1 and 2 are perspective views of a pack compression system 10 supported upon a user's back by a frame 14, a shoulder support assembly 16, and a belt assembly 18. Frame 14, shoulder support assembly 16, and belt assembly 18 are described in greater detail in co-pending U.S. patent applications Ser. No. 08/669,752, entitled "Interchangeable Load Carrying System" and filed on Jun. 26, 1996; Ser. No. 08/670,586, entitled "Quick-Release Pin Latch Assembly" and filed on Jun. 26, 1996; Ser. No. 08/673,742, entitled "Flexible Frame Load Carrying System" and filed on Jun. 26, 1996; Ser. No. 08/762,569, entitled "Belt Assembly for a Load Carrying System" and filed on Dec. 9, 1996; and Ser. No. 08/762,607, entitled "Shoulder Support Structure Frame Load Carrying System" and filed on Dec. 9, 1996, herein incorporated by reference. Although pack compression system 10 is illustrated as being supported upon the user's back by frame 14, shoulder support assembly 16, and belt assembly 18, pack compression system 10 may alternatively be supported on the user's back by a variety of other alternative support structures used to support a pack on the user's back. Moreover, pack compression system 10 may alternatively be configured so as to be supported on the user's back without the assistance of separate support structures.

Figure 4:
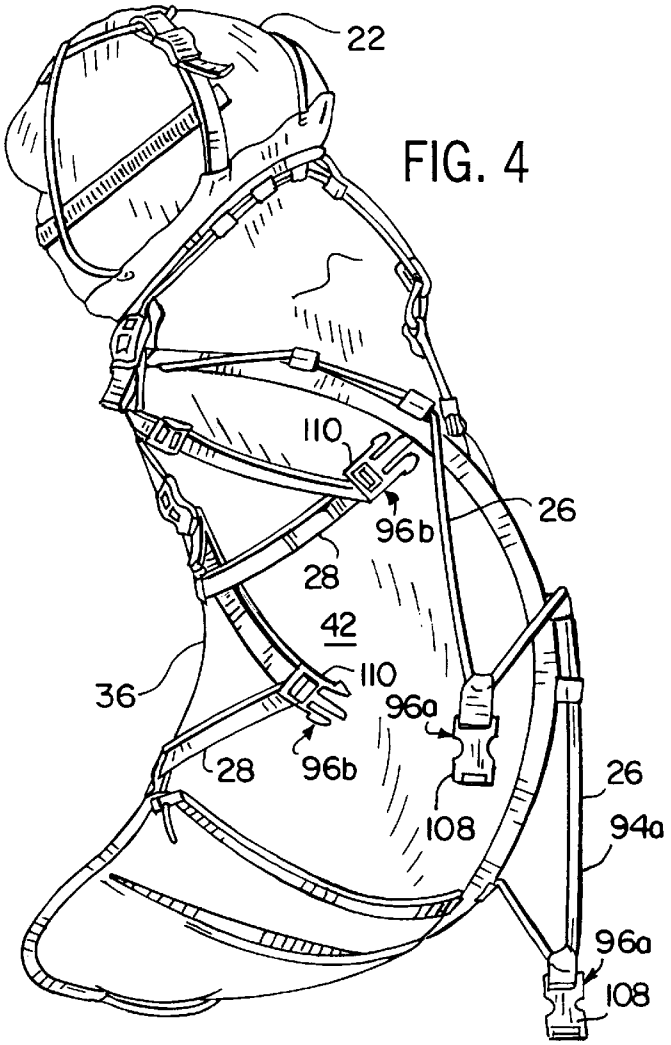
FIG. 4 is a side elevational view of the pack compression system of FIG. 3.
Figure 3:
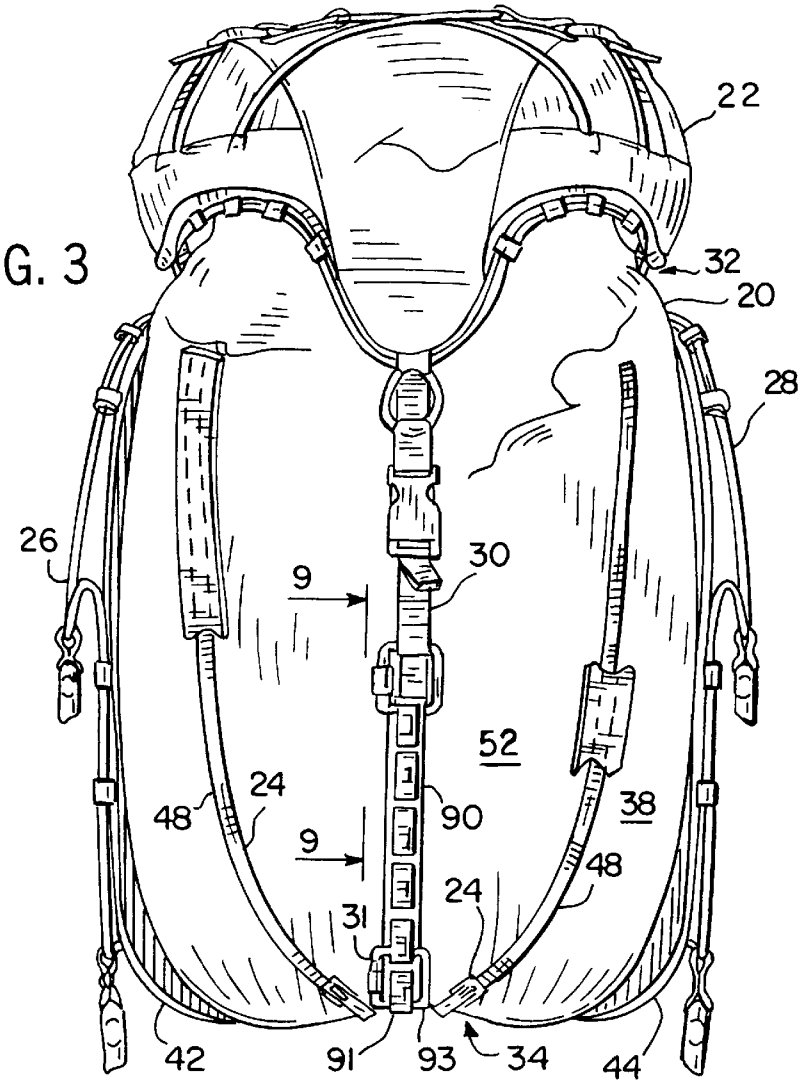
FIG. 3 is a front elevational view of the pack compression system with the main pack in an uncompressed state.

As best shown by FIGS. 3 and 4, pack compression system 10 generally includes main pack 20, auxiliary pack 22, closing mechanisms 24 and compression mechanisms 26, 28, 30, and 31. Main pack 20 has a top 32 and a bottom 34, and generally includes back panel 36, front panel 38, and side panels 42, 44. Back panel 36 extends between top 32 and bottom 34 and is configured for being positioned proximate the user's back. Front panel 38 extends between top 32 and bottom 34 opposite back panel 36. Side panels 42, 44 extend between back panel 36 and front panel 38, while spacing back panel 36 from front panel 38. Panels 36, 38, 42, and 44 preferably comprise individual panels which are sewn together. Alternatively, panels 36, 38, 42, and 44 may be secured to one another by various other attachment methods or may be formed by deforming, creasing, or folding larger sheets or panels to form panels 36, 38, 42, and 44 in conjunction with one another. Because side panels 42 and 44 are preferably semicircular in shape, front panel 38 extends adjacent to back panel 36 at both the top 32 and bottom 34 of main pack 20. As a result, the largest volume of main pack 20 is centered between top 32 and bottom 34 at the pack's center of gravity.

Back panel 36, front panel 38, and side panels 42, 44 define an internal storage volume of main pack 20. To provide access to the internal storage volume of main pack 20, front panel 38 includes main opening 48 and top opening 50 (shown in FIGS. 6 and 8). Main opening 48 longitudinally extends between top 32 and bottom 34 through front panel 38 opposite back panel 36. As best shown by FIG. 3, main opening 48 is preferably V-shaped with a corresponding V-shaped door or flap 52 formed as part of front panel 38. As a result, flap 52 may be pivoted to open main opening 48, whereby the user may view and access the entire interior storage volume of main pack 20. At the same time, because opening 48 is formed within front panel 38 opposite back panel 36, overfilling of the interior storage volume of main pack 20 between back panel 36 and front panel 38 does not exert stress directly on closing mechanisms 24. Consequently, opening 48 is easier to close and the useful lives of closing mechanisms 24 are prolonged. As shown by FIG. 3, closing mechanisms 24 preferably comprise a pair of zippers which release flap 52 from the remainder of front panel 38 as the zippers are pulled towards top 32. In lieu of zippers, closing mechanisms 24 may comprise other well-known fastening or closing arrangements.

Figure 6:
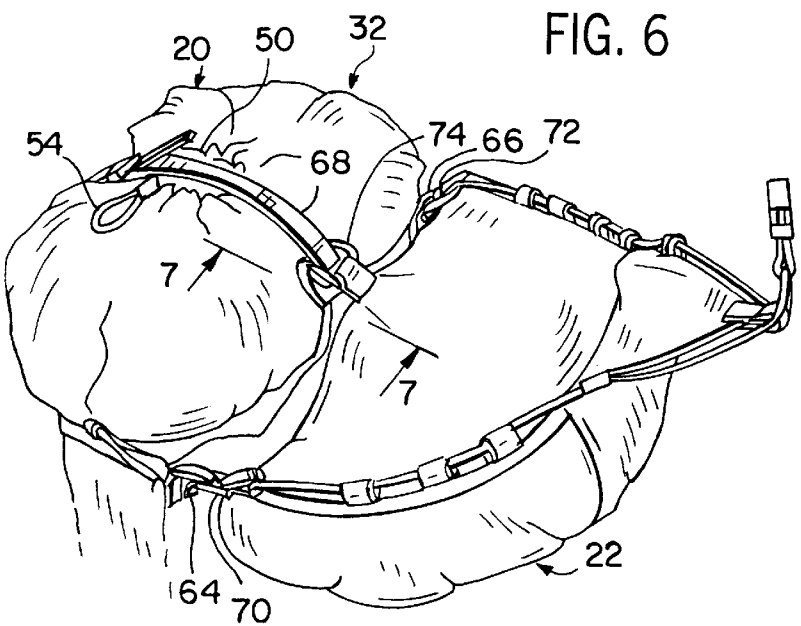
FIG. 6 is a perspective view of the auxiliary pack pivoted away from the main pack of the pack compression system.
Figure 8:
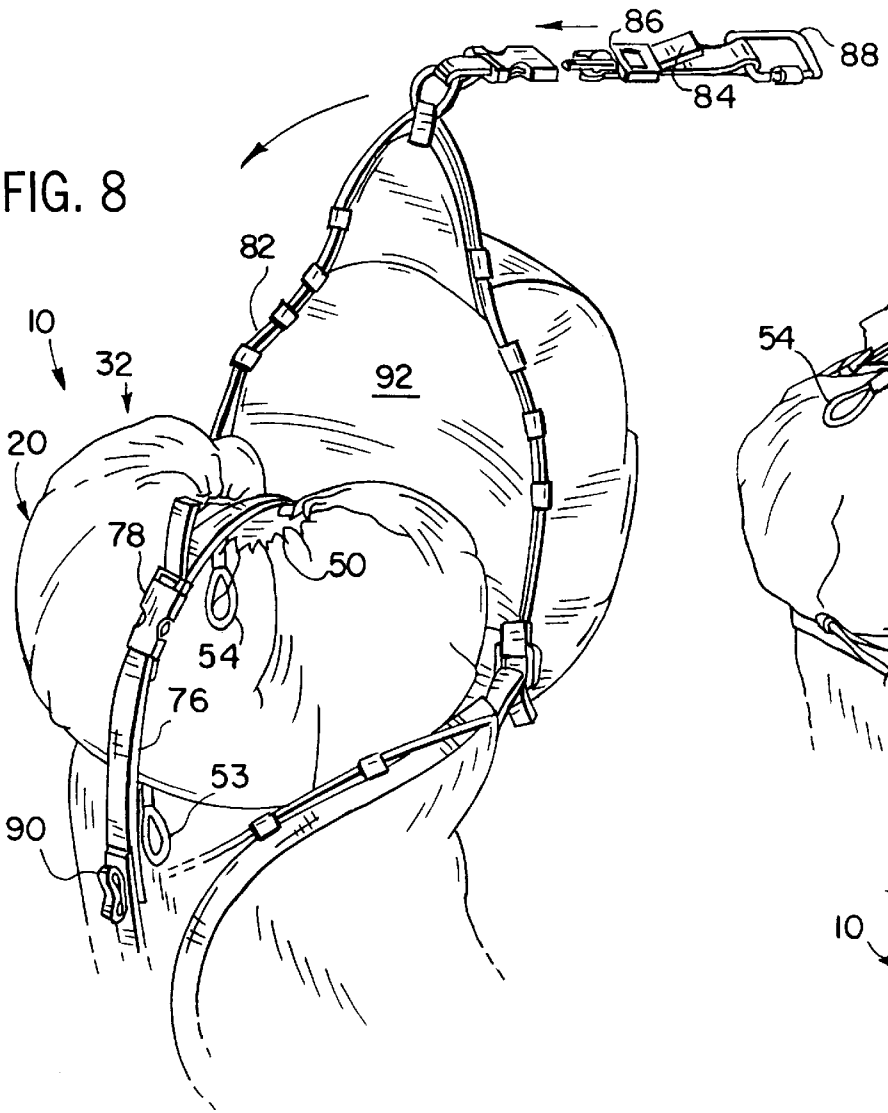
FIG. 8 is a fragmentary perspective view of the pack compression system with the auxiliary pack pivoted away from the main pack.

As best shown by FIGS. 6 and 8, front panel 38 extends adjacent to back panel 36 at top 32 of main pack 20 below top opening 50. Front panel 38 includes a drawstring 53 sewn within and about opening 50. Tightening of drawstring 53 draws portions of front panel 38 together below opening 50 to divide the interior storage volume of main pack 20 into two separate compartments for separating items. Alternatively, drawstring 53 may be loosened for complete communication throughout the interior storage volume of main pack 20. As shown by FIGS. 6 and 8, top opening 50 is also opened and closed by a drawstring 54 sewn in and about the perimeter of opening 50.

Compression mechanisms 26, 28, 30, and 31 interact with panels 36, 38, 42, and 44 to compress the contents stored within the internal storage volume of main pack 20. In particular, as described in greater detail with respect to FIGS. 10–15 hereafter, compression mechanisms 26 and 28 extend across opening 48 to compress side panels 42 and 44, respectively, towards a longitudinal center line of main pack 20 and towards back panel 36. Compression mechanisms 30 and 31 compress top 32 and bottom 34, respectively, towards a transverse center line of main pack 20. As a result, the internal storage volume of main pack 20 is symmetrically compressed from opposite longitudinal and lateral sides of opening 48 to prevent items within the internal storage volume from shifting and to maintain the items in alignment with the pack's center of gravity.

FIGS. 5–8 illustrate auxiliary pack 22 in greater detail. Similar to main pack 20, auxiliary pack 22 defines an internal storage volume for storing items. As best shown by FIG. 5, auxiliary pack 22 includes compression mechanisms 56, 58. Compression mechanisms 56 and 58 are substantially identical to one another and compress from opposite directions relative to pack 22. Each of compression mechanisms 56 and 58 includes strap portions 60 and 62. Strap portions 60 are each attached at opposite lower corners of pack 22 and extend partially across a top of pack 22 at which point portions 60 are coupled to strap portions 62. Strap portions 62 are fixedly attached at lower intermediate portions of pack 22 and have an adjustable length. Shortening the length of strap portions 62 pulls the connected strap portions 60 towards the opposite side of pack 22 to compress the contents of pack 22.

Figure 7:
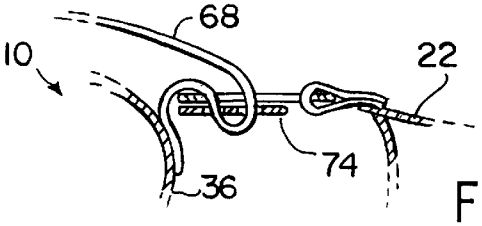
FIG. 7 is a sectional view of the pack compression system of FIG. 6 taken along lines 7—7.

As best shown by FIGS. 6 and 7, auxiliary pack 22 is removably attached to top 32 of main pack 20 by straps 64, 66, and 68. Straps 64 and 66 are located on opposite lateral sides of main pack 20 and attach pack 22 to main pack 20 by ladder locks 70, 72. Straps 68 extends through a ladder lock 74 attached to auxiliary pack 22 and further extends over and across top opening 50 of main pack 20 for being releasably secured to front panel 38 via strap 76 and adjustable buckle 78. As a result, straps 68, straps 76, and buckle 78 allow the user to adjustably compress top 32 of main pack 20 across top opening 50.

Figure 9:
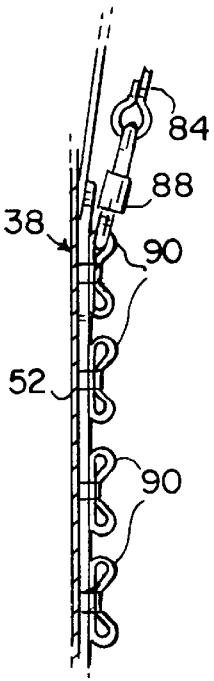
FIG. 9 is a sectional view of the pack compression system of FIG. 3 taken along lines 9—9.
Figure 10:
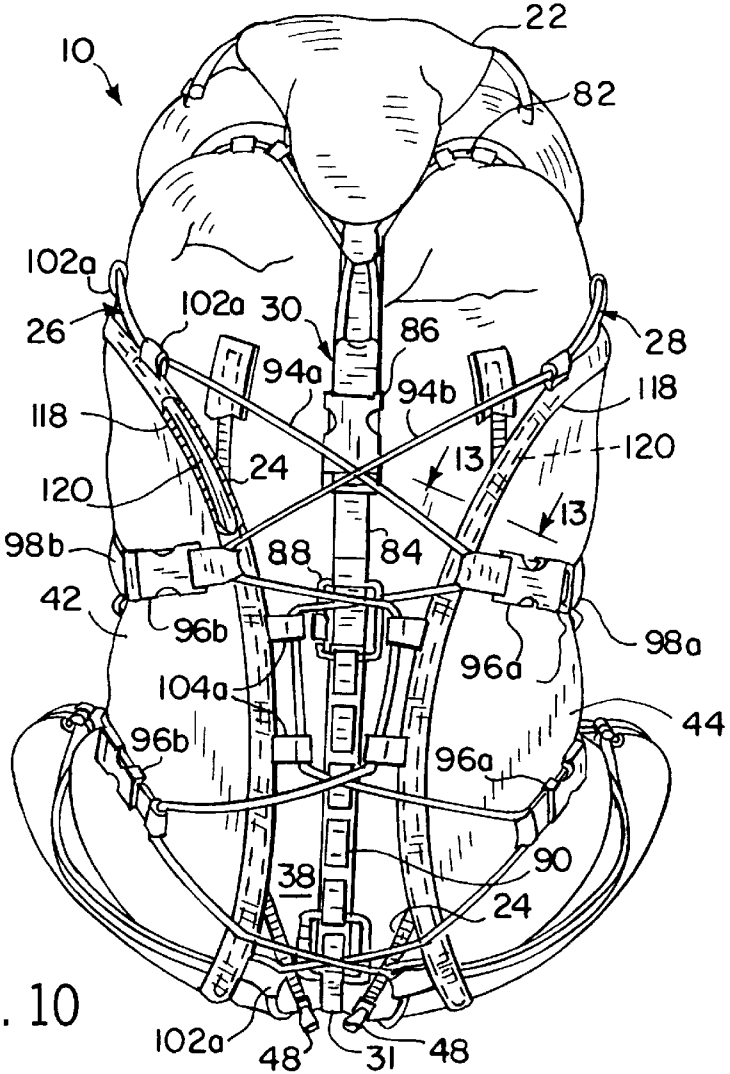
FIG. 10 is a front elevational view of the pack compression system with the main pack in a compressed state.

FIGS. 8, 9, and 10 illustrate compression mechanism 30 in greater detail. As best shown by FIG. 8, compression mechanism 30 includes strap portion 82, strap portion 84, adjustable buckle 86, connector 88, and front panel connector points 90. Strap portion 82 preferably comprises a cord attached along and about a lower perimeter of auxiliary pack 22 and attached to a first portion of buckle 86. Strap portion 84 extends between a second portion of buckle 86 and connector 88. Buckle 86 enables strap portion 84 to be releasably connected to strap portion 82. Buckle 86 additionally allows the length of strap portion 84 to be adjusted for precise compression adjustment. Connector 88 is secured to strap portion 84 and is configured for attachment to one of the plurality of front panel connector points 90.

As best shown by FIGS. 9 and 10, connectors 90 longitudinally extend between top 32 and bottom 34 along the longitudinal center line of front panel 38. As best shown by FIG. 10, connector 88 may be releasably connected to any one of the plurality of front panel connector points 90 along front panel 38 to accommodate different volumes of main pack 20 and to adjust the amount of compression applied to top 32 of main pack 20. As shown by FIG. 10, attachment of connector 88 to one of front panel connector points 90 forces a bottom panel 92 of auxiliary pack 22 over and against opening 50 and top 32 of main pack 20. Because strap portion 82 is attached along and about the perimeter of bottom panel 92, the entire area bottom panel 92 is pulled downward against top 32 to compress the internal storage volume. Connector 88 and connector points 90 enable quick, relatively large adjustments of the compression applied by panel 92 of auxiliary pack 22. Because front panel connector points 90 extend along front panel 38, relatively large adjustments of the compression applied by panel 92 may be achieved without the need for corresponding long strap reserve or tail hanging from adjustable buckle 86. At the same time, strap portion 84 and adjustable buckle 86 enable precise, more refined adjustments of the compression applied by panel 92.

In the preferred embodiments illustrated, connector 88 comprises a carabiner while connector points 90 preferably comprise a plurality of loops, preferably in the form of a daisy chain, secured to front panel 38. Alternatively, various other connectors and connector points may be used. Moreover, in lieu of strap portion 84 being releasably connected to strap portion 82 by a buckle 86, strap portion 84 may be fixedly attached or integrally formed with strap portion 82 with a buckle for adjusting the overall length of strap portion 84.

As best shown by FIG. 3, compression mechanism 31 is similar to compression mechanism 30 and also utilizes front panel connectors points 90. Similar to compression mechanism 30, compression mechanism 31 includes a first strap portion (not shown) attached adjacent back panel 36 of main pack 20 and attached to an adjustable buckle (not shown) similar to adjustable buckle 86. Compression mechanism 31 further includes a second strap portion 91 having one end secured to the adjustable buckle and having a second end secured to connector 93. Connector 93 is essentially identical to connector 88 and is configured for releasable attachment to one of the plurality of front panel connectors 90. As with connector 88 and connector points 90 of compression mechanism 30, connector 93 and connector points 90 of compression mechanism 31 enable quick, relatively large adjustments of the compression of the bottom of main pack 20 without a correspondingly long strap reserve or tail. At the same time, the adjustable buckle (not shown) also enables precise, more refined adjustments to the compression applied to the bottom of main pack 20.

Figure 14:
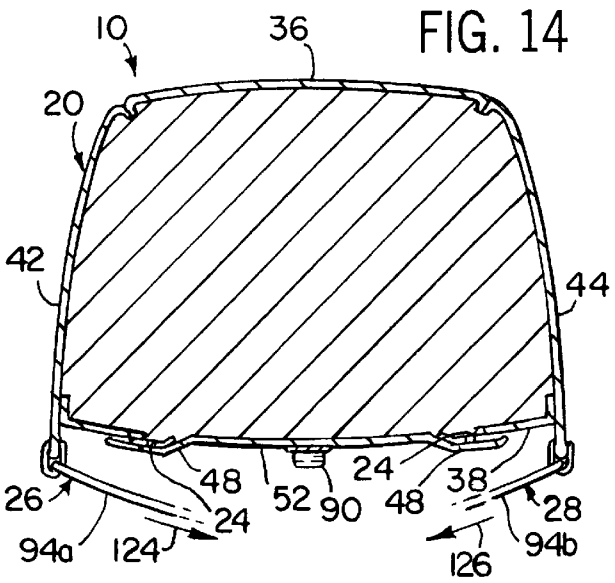
FIG. 14 is a sectional view of the main pack in an uncompressed state.
Figure 15:
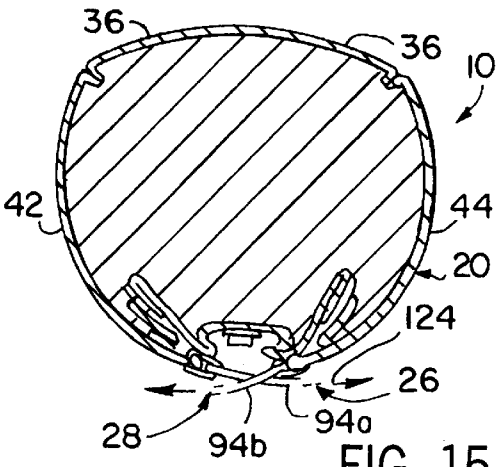
FIG. 15 is a sectional view of the main pack in a compressed state.
Figure 11:
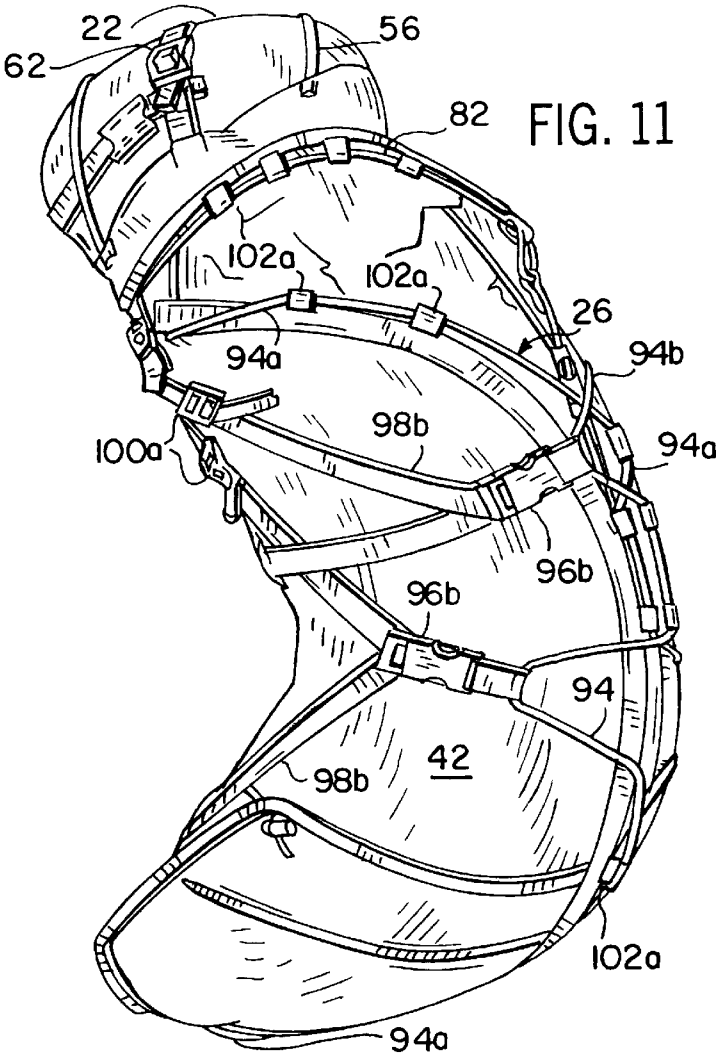
FIG. 11 is a side elevational view of the pack compression system of FIG. 10.

FIGS. 10—15 illustrate compression mechanisms 26 and 28 in greater detail. FIGS. 10, 11, and 15 illustrate compression mechanisms 26 and 28 secured to symmetrically compress the internal storage volume of main pack 20. As best shown by FIGS. 10 and 11, compression mechanisms 26 and 28 generally include strap portions 94*a*, 94*b*, connectors 96*a*, 96*b*, strap portions 98*a*, 98*b*, and connectors 100*a*, 100*b*, respectively. Strap portion 94*a* is an elongate flexible mechanism having opposite ends fixedly attached to main pack 20 proximate top 32 and bottom 34 and adjacent to back panel 36 of main pack 20. Strap portion 94*a* is slidably attached to and along the perimeter of side panel 42 via sleeves 102*a* and is fixedly attached to and along the perimeter of side panel 42 via sleeves 104*a* at a midpoint of side panel 42. Strap portion 94*a* is further slidably attached to adjustable buckles 96*a* on opposite sides of sleeves 104*a* between sleeves 104*a* and adjacent sleeves 102*a*. Strap portion 94*b* is identical to strap portion 94*a* except that strap portion 94*b* is secured to and along the perimeter of side panel 44 instead of side panel 42.

Connectors 96*a*, 96*b* are coupled between strap portions 94*a*, 94*b* and strap portions 98*a*, 98*b*, respectively, to releasably interconnect strap portions 94*a*, 94*b* and 98*a*, 98*b*, respectively. As shown by FIG. 4, each of connectors 96*a*, 96*b* includes interconnectable components 108 and 110. As best shown by FIG. 11, component 108 of connector 96*b* is attached to strap portion 94*b* while component 110 is secured to strap portion 98*b*. Connectors 96*a* are similarly configured. Components 108 and 110 are configured to interact with one another such that components 108 and 110 may be securely interconnected to one another to interconnect strap portions 94*a*, 94*b* to strap portions 98*a*, 98*b*, respectively, for compression or, alternatively, to allow strap portions 94*a*, 94*b* to be separated from strap portions 98*a*, 98*b*, respectively, for expansion and unloading of main pack 20. As can be appreciated, a variety of releasable attachment mechanisms may be used to releasably secure strap portions 94*a*, 94*b* to strap portions 98*a*, 98*b*, respectively.

Strap portions 98*a*, 98*b* are generally elongate strap-like mechanisms coupled between connectors 96*a*, 96*b*, respectively, and portions of main pack 22 proximate both back panel 36 and side panels 42, 44, respectively. Strap portions 98*b* preferably have opposite ends fixedly coupled to back panel 36 proximate side panel 42 with connector 96*b* adjustably supported therebetween. Strap portions 98*a* are similarly configured.

Connectors 100*a*, 100*b* comprise conventionally-known ladder locks coupled between strap portions 98*a*, 98*b*, respectively, and back panel 36. Connectors 100*a*, 100*b* are coupled to strap portions 98*a*, 98*b* and are configured to adjust the length of strap portions 98*a*, 98*b* so as to enable the user to adjust the degree that compression mechanisms 26, 28 compress main pack 20.

Figure 12:
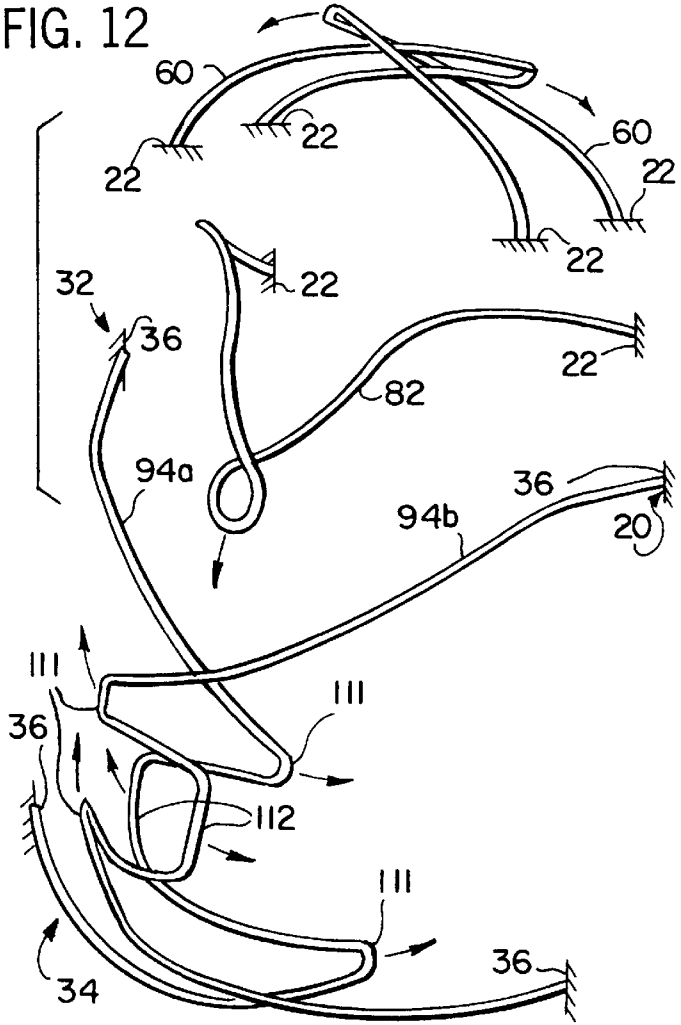
FIG. 12 is a perspective view illustrating portions of a compression mechanism of the pack compression system of FIGS. 1–11.

FIG. 12 is a perspective view illustrating the resulting forces applied to strap portions 60 of compression mechanisms 56, 58, to strap portion 82 of compression mechanism 30, and to strap portions 94*a*, 94*b* of compression mechanisms 26, 28. As shown by FIG. 12, strap portions 60 have ends which are fixedly secured to auxiliary pack 22 and overlap one another across auxiliary pack 22 to compress auxiliary pack 22. Strap portion 82 has ends fixedly secured to auxiliary pack 22 and is forced downwardly by buckle 86 (shown in FIG. 10) to downwardly compress the top 32 of main pack 20. Strap portions 94*a* and 94*b* have ends fixedly secured to back panel 36 of main pack 20 proximate top 32 and bottom end 34 of main pack 20. Strap portion 94*a* and 94*b* overlap one another between top 32 and bottom 34 of main pack 20 and have portions 111, which are pulled towards an opposite side of main pack 20, and portions 112, which are pulled toward the same side of main pack 20. Portions 111 and 112 preferably alternate along the length of strap portion 94*a* and 94*b*. As a result, each of strap portions 94*a*, 94*b* compresses front panel 38 of main pack 20 towards back panel 36 of main pack 20. Strap portions 94*a*, 94*b* further compress panels 42 and 44 towards one another to symmetrically compress the contents of main pack 20.

Figure 13:
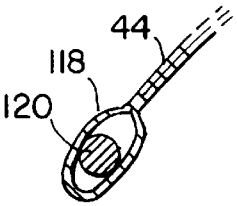
FIG. 13 is a fragmentary sectional view of the pack compression system of FIG. 10 taken along lines 13—13.

FIG. 13 is a cross-sectional view of panel 44 taken along lines 13—13 of FIG. 10. As best shown by FIG. 13, the perimeter of panel 44 includes an elongate sleeve 118 along its length which receives a substantially rigid mechanism 120. Mechanism 120 rigidifies the entire perimeter of panel 44. As a result, forces applied to portions of the perimeter of panel 44 are distributed along substantially the entire perimeter of panel 44 to evenly compress the entire panel 44 against the contents of main pack 20. As shown by FIG. 10, panel 42 is similarly constructed.

In the preferred embodiment illustrated, mechanism 120 preferably comprises an elongate rod made of Delrin. Alternatively, mechanism 120 can be formed from a variety of alternative materials which would substantially rigidify the perimeter of panels 42 and 44. These rigid materials may be integrally formed with or fixedly attached to and along the perimeters of panels 42 and 44 by various alternative methods in lieu of sleeve 118.

FIGS. 14 and 15 are cross sectional views of main pack 20 illustrating compression mechanisms 26, 28 being actuated to compress the contents of main pack 20. FIG. 14 illustrates main pack 20 in an expanded state, while FIG. 15 illustrates main pack 20 in a compressed state. As best shown by FIGS. 14 and 15, main pack 20 is compressed by pulling strap portion 94*a* of compression mechanism 26 towards panel 44 across opening 48 in the direction indicated by arrow 124 and by also pulling strap portion 94*b* of compression mechanism 28 towards panel 42 across opening 48 in the direction indicated by arrow 126. As further shown by FIGS. 10 and 11, strap portions 94*a* and 94*b* are secured in place to strap portions 98*a*, 98*b* by connectors 96*a*, 96*b*, respectively. Because strap portions 98*a*, 98*b* are secured proximate to back panel 36, strap portions 94*a*, 94*b* are pulled both across opening 48 and towards back panel 36. As a result, the contents of main pack 20 are symmetrically compressed towards the longitudinal center line of main pack 20 between top 32 and bottom 34 and also towards back panel 36.

In addition to providing symmetrical compression of main pack 20, compression mechanisms 26 and 28 also relieve stresses exerted upon closing mechanisms 24 used to close opening 48. As shown by FIG. 15, because compression mechanisms 26 and 28 extend towards, and preferably across, opening 48, compression mechanisms 26 and 28 reduce tension within front panel 38 to further reduce stress applied to closing mechanisms 24. Consequently, the useful life of closing mechanisms 24 is prolonged. Moreover, opening 48 may be larger to provide accessibility to substantially the entire longitudinal length of main pack 20 between top 32 and bottom 34 without substantially increasing the potential for failure of closing mechanism 24. Because panels 42 and 44 have a length greater than the distance separating back panel 36 and front panel 38, panels 42 and 44 partially overlap front panel 38 upon compression of main pack 20. As a result, panels 42 and 44 also more effectively compress the contents of main pack 20 towards back panel 36.

Although pack compression system 10 is illustrated as utilizing side panels 42 and 44 for defining the interior of main pack 20 and also for compressing the interior of main pack 20 as a result of being connected to strap portions 94*a* and 94*b*, pack compression system 10 may alternatively include a first pair of side walls extending between back panel 36 and front panel 38 for defining the interior of main pack 20 and a second set of independent side panels coupled to main pack 20 proximate back panel 36 and connected to strap portions 94*a*, 94*b* for compressing the interior of main pack 20.

FIGS. 16–21 illustrate a generally horizontal receptacle 210, sometimes known as a duffel bag, a gym bag, or an overnight bag, configured to be manually carried by a user at the user's side. Horizontal receptacle 210 generally includes bottom panel 212, top panel 214, side panels 216, 218, side handles 222, 224, and end handles 226, 228 and compression mechanisms 230, 232. Bottom panel 212, top panel 214, and side panels 216, 218 define an internal storage volume 234 (shown in FIG. 19), configured to receive various articles which are supported by bottom panel 212 between side panels 216, 218 and below top panel 214.

Bottom panel 212 generally serves as a base for supporting receptacle 210 upon a supporting surface 236 when receptacle 210 is not being manually carried and for supporting items within receptacle 210. Bottom panel 212 generally extends between opposite ends 238 and 240 of receptacle 210 and between opposite sides 242, 244 of receptacle 210. Bottom panel 212 preferably has a bottom surface 246 which is resistant to wear and abrasion. Alternatively, bottom panel 212 may be provided with feet or other similar members for elevating bottom panel 212 above surface 236. Although bottom panel is preferably formed from a somewhat flexible polymeric material, bottom panel 212 may be formed by multiple members and may be formed from a flexible fabric, such as, canvas or another flexible material, wherein bottom panel 212 includes a stiffening material or a stiffener member.

Top panel 214 extends generally opposite bottom panel 212 and includes at least one opening 250 therethrough for accessing interior storage volume 234. Opening 250 preferably extends along a substantial portion of top panel 214 between ends 238 and 240. In the exemplary embodiment, opening 250 is generally rectangular for providing access to a large portion of volume 234. As a result, top panel 212 includes a generally rectangular flap 252 that is closable by closing mechanism 220. Alternatively, opening 250 may have various other configurations and may be formed at various alternative locations in top panel 214. For example, opening 250 may alternatively comprise a single elongate slit extending between ends 238 and 240 through top panel 214. In the exemplary embodiment illustrated, top panel 214 extends from bottom panel 212 at end 238 to bottom panel 212 at end 240 and between side panels 216 and 218. As a result, top panel 214 extends in a semi-circular arc. Alternatively, horizontal receptacle 210 may additionally be provided with one or more end panels which extend from back panel 212 at ends 238 and 240 to top panel 214. In such an alternative embodiment, receptacle 210 would have more of a rectangular shape. Top panel 214 is preferably formed from a flexible material. In the exemplary embodiment, top panel 214 is formed from a flexible fabric, such as, nylon.

Figure 18:
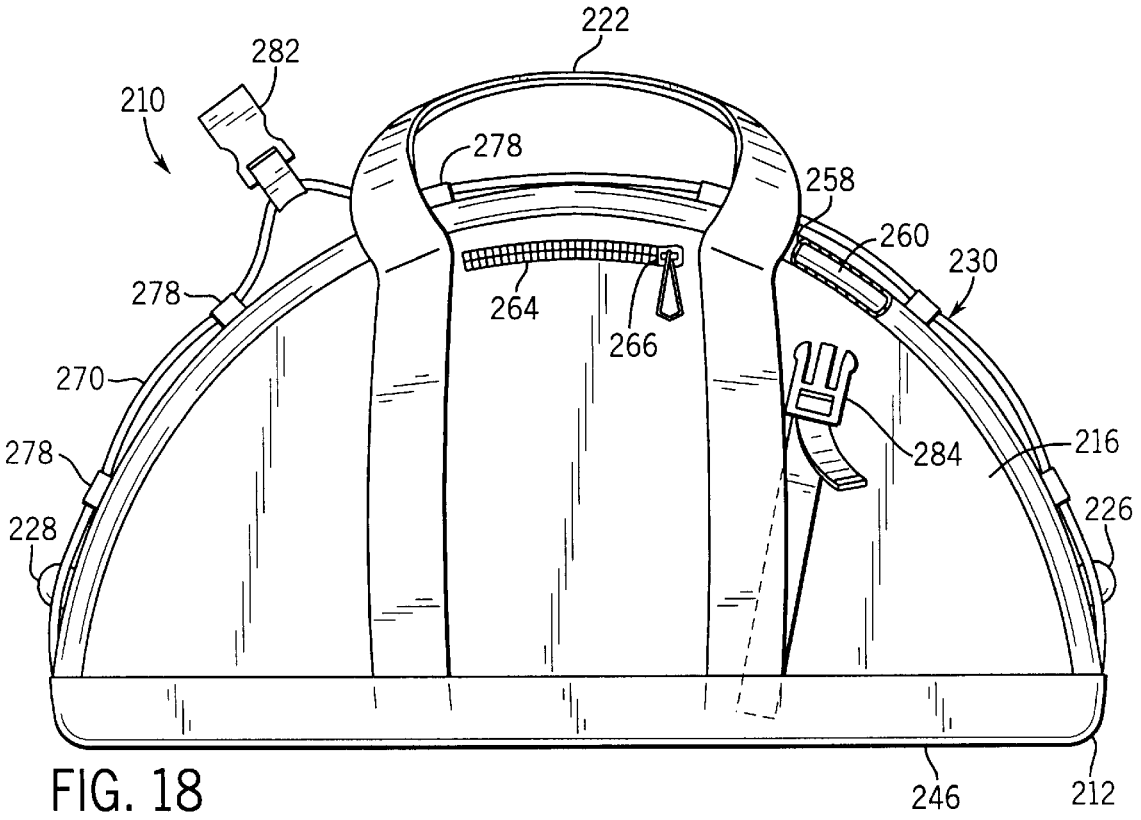
FIG. 18 is a side elevational view of the receptacle compression system of FIG. 16.
Figure 19:
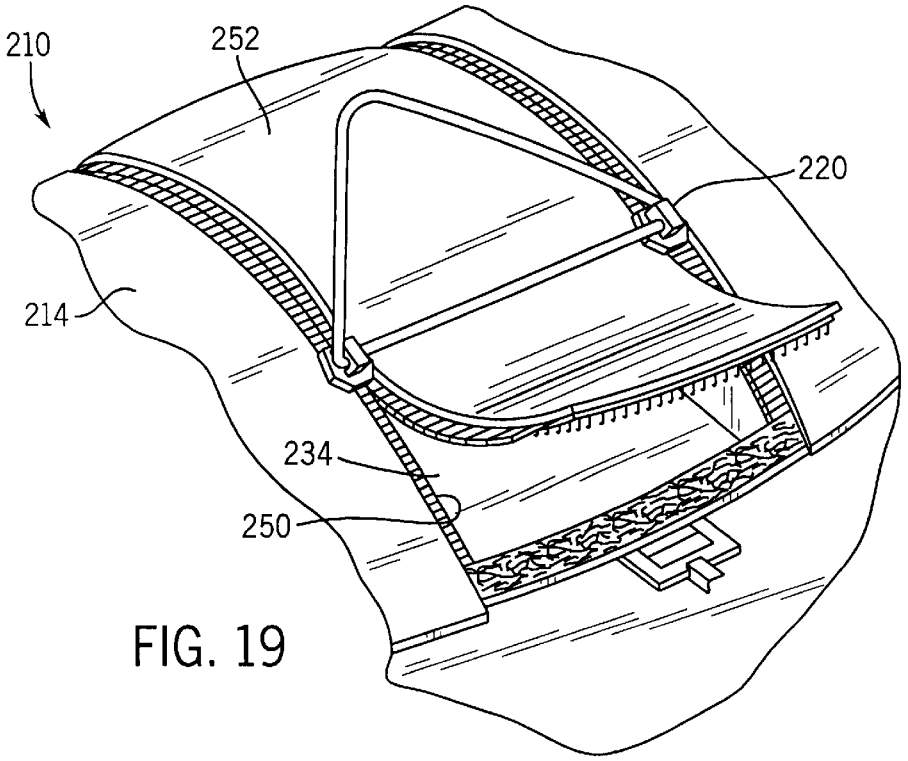
FIG. 19 is a fragmentary top perspective view of the receptacle compression system of FIG. 16 illustrating a closing mechanism actuated to provide an opening to access an interior.

Side panels 216, 218 extend from bottom panel 212 at sides 242 and 244, respectively, to top panel 212. In the exemplary embodiment, side panels 216 and 218 are generally semi-circular in shape. Alternatively, side panels 216, 218 may have various sizes and configurations, depending upon the shape of top panel 214 and the inclusion of additional panels, such as, the previously noted end panels. Side panels 216, 218 are each preferably formed from a relatively flexible material and include a substantially rigid perimeters 256. As best shown by FIG. 18, rigid perimeters 256 include an elongate sleeve 258 that receives a substantially rigid member of mechanism 260. Mechanism 260 rigidifies the entire perimeter 256. As a result, forces applied to portions of perimeter 256 of either side panel 216 or side panel 218 are distributed along substantially the entire perimeter 256. In the preferred embodiment, mechanism 260 comprises an elongate rod made of Delrin. Alternatively, mechanism 260 can be formed from a variety of alternative materials which would substantially rigidify the perimeter 256 of each of panels 216 and 218. These rigid materials may be integrally formed with or fixedly attached to and along the perimeters 256 of panels 216, 218 by various alternative methods in lieu of sleeve 258.

In the exemplary embodiment, side panels 216, 218 are formed from a flexible fabric, such as, nylon. Alternatively, side panels 216, 218 may be formed from a variety of alternative flexible materials. Moreover, side panels 216, 218 may alternatively be entirely formed from substantially rigid material. As best shown by FIG. 18, side panel 216 includes an optional pocket 264 closed by a closing mechanism 266. Closing mechanism 266 preferably comprises a zipper.

Closing mechanism 220 extends along the edges of opening 250 and closes opening 250. Closing mechanism 220 preferably comprises a pair of zippers which release flap 252 from the remainder of top panel 214 as the zippers are pulled towards end 240. In lieu of zippers, closing mechanism 220 may comprise other well-known fastening or closing arrangements.

Side handles 222, 224 are coupled to side panels 216 and 218, respectively, and are configured for being simultaneously grasped by a user's hand for manually carrying receptacle 210 with bottom panel 212 extending substantially parallel to the ground or a floor. In the exemplary embodiment, handles 222, 224 comprise elongate bands having ends affixed to side panels 216, 218 to form opposing flexible loops through which the user's hand may be inserted. Although handles 222, 224 illustrated as being affixed to side panels 216, 218, handles 222, 224 may alternatively be affixed to bottom panel 212 along sides 242 and 244, respectively.

End handles 226, 228 are affixed to receptacle 210 along top panel 214 at ends 238 and 240, respectively. End handles 226 and 228 extend between side panels 216 and 218 and are configured for enabling the user to manually carry receptacle 210 with bottom panel 212 extending substantially perpendicular to the ground or other floor surface. Although end handles 226, 228 are illustrated as being affixed to top panel 214, in alternative embodiments where receptacle 210 additionally includes end panels, handles 226, 228 may be affixed to such end panels between side panels 216, 218. Although less desirable, end handles 226, 228 may be omitted.

Compression mechanisms 230, 232 are substantially identical to one another except that compression mechanism 230 and 232 are configured opposite to one another adjacent to side panels 216 and 218. Compression mechanism 230, 232 interact with panels 216 and 218 to compress the contents stored within internal storage volume 234 of receptacle 210. As described in greater detail hereafter, compression mechanisms 230, 232 extend across opening 250 to compress side panels 216, 218, respectively, towards one another. As a result, the internal storage volume 234 of receptacle 210 is symmetrically compressed from opposite sides 242, 244 of opening 250 to prevent items within the internal storage volume 234 from shifting and to relieve closing mechanism 220 from the inherent stresses resulting from volume 234 being overfilled.

Figure 16:
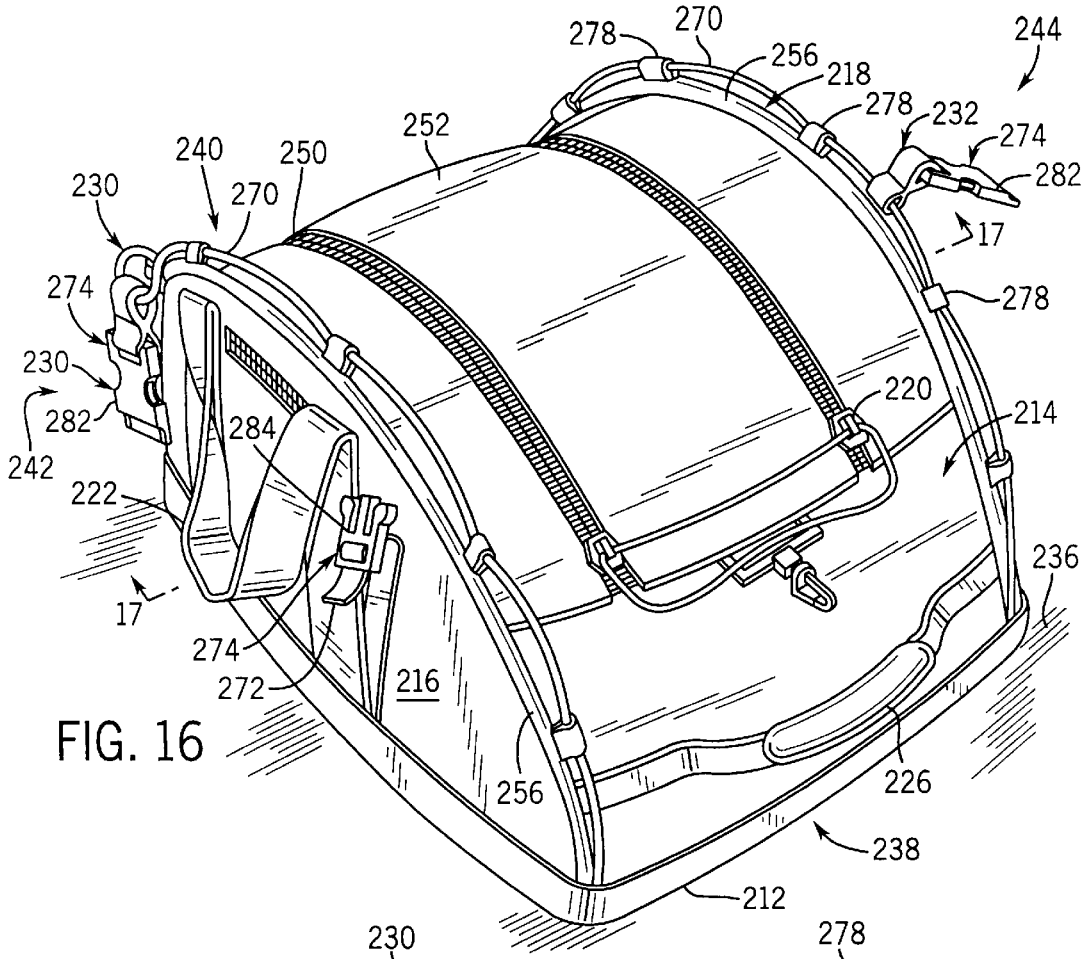
FIG. 16 is a top perspective view of an exemplary embodiment of the receptacle compression system of the present invention in an uncompressed state.
Figure 21:
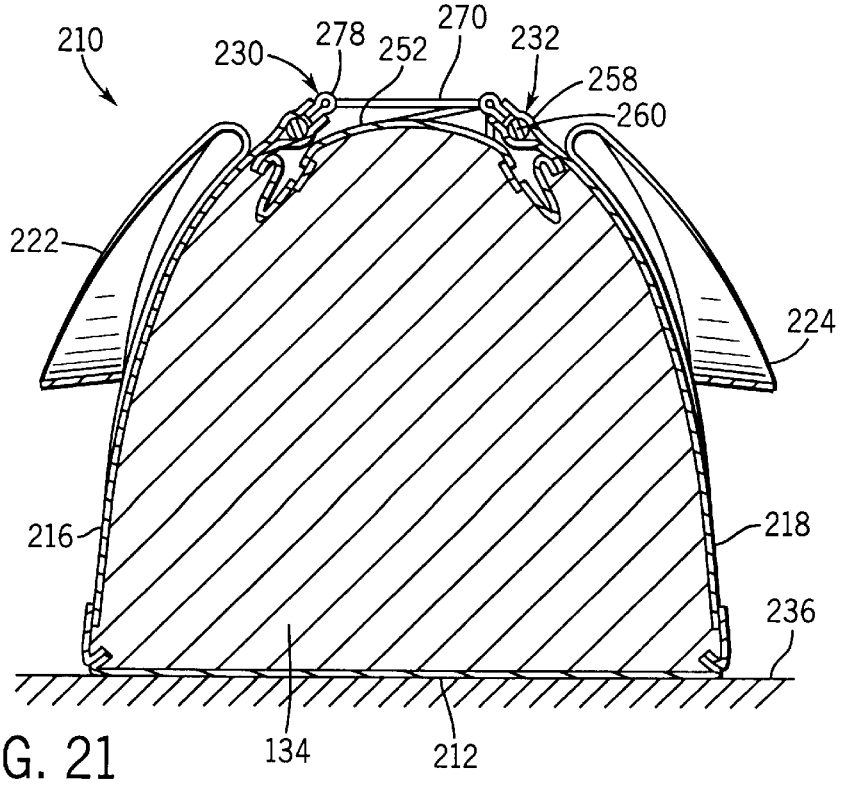
FIG. 21 is a sectional view of the receptacle compression system of FIG. 20 taken along lines 21—21.

FIGS. 16, 18, and 21 best illustrate compression mechanisms 230 and 232. FIGS. 16 and 18 illustrate compression mechanisms 230 and 232 in an unactuated state. FIG. 21 illustrates compression mechanisms 230 and 232 in an actuated state compressing the internal storage volume 234 of receptacle 210. Compression mechanisms 230 and 232 each preferably comprise tension members or straps which include strap portions 270, 272, and connector 274. Strap portions 270 of mechanisms 230 and 232 are elongate flexible tension members coupled to receptacle 210 proximate the junction of top panel 214 and side panels 216, 218, respectively. In the exemplary embodiments, strap portions 270 are coupled to perimeters 256 of side panels 216 and 218 at a plurality of locations along the perimeters 256 of side panels 216 and 218. Preferably, strap portions 270 are connected to the perimeters 256 of side panels 216 and 218 by sleeves 278 located along the perimeters 256 of side panels 216 and 218. Sleeves 278 are affixed to perimeters 256 of side panels 216 and 218 and slidably receive strap portions 270. Although less desirable, strap portions 270 may be coupled to side panels 216, 218 or to top panel 214 proximate to side panels 216, 218 by various other coupling mechanisms, such as, adhesives, stitching, fasteners, fusion bonds, and the like.

Strap portions 272 comprise elongate flexible tension members coupled to receptacle 210 proximate to the junction of bottom panel 212 and side panel 216 and bottom panel 212 and side panel 218, respectively. In the exemplary embodiment, each strap portion 272 has an end affixed by stitching to side panels 216 and 218 near bottom panel 212 and have a second opposite end secured to connector 274. In the exemplary embodiment, one strap portion 272 is located along side panel 216 towards end 238 while the other of strap portions 272 (not shown) is disposed along side panel 218 towards end 240.

Figure 17:
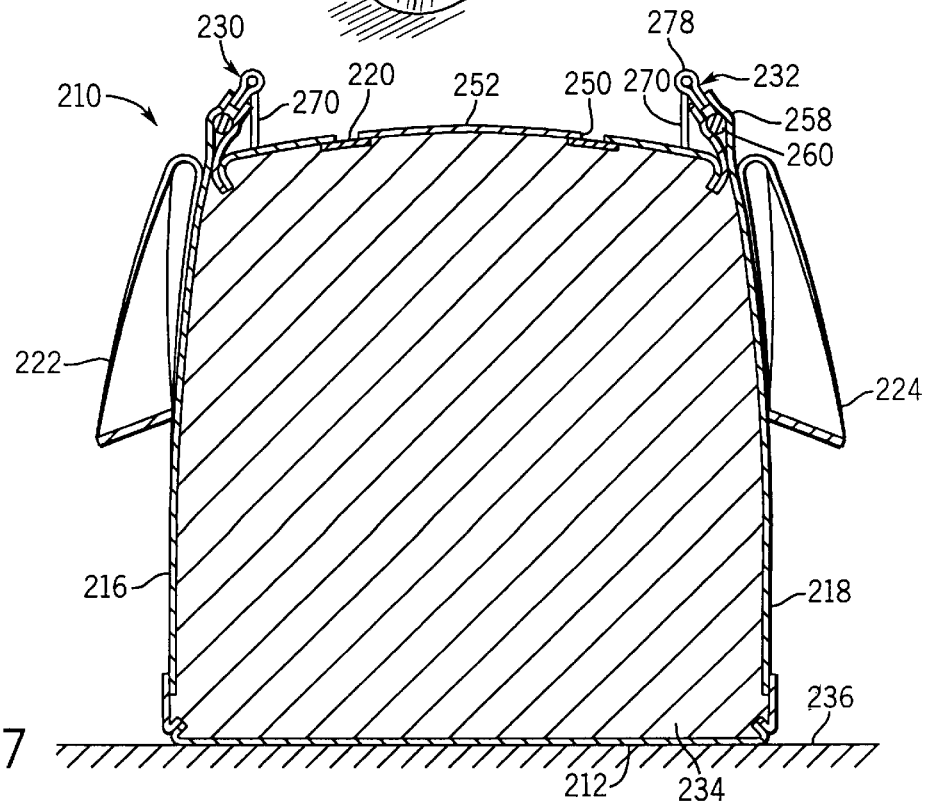
FIG. 17 is a sectional view of the receptacle compression system of FIG. 16 taken along lines 17—17.

Connectors 274 are coupled between strap portions 270 and strap portions 272 to releasably interconnect strap portions 270 and strap portions 272 for compressing internal storage volume 234. As best shown by FIGS. 17 and 18, each connector 274 includes interconnectable components 282, 284 secured to strap portions 270 and 272, respectively. In the exemplary embodiment, component 282 is slidably secured along strap portion 270 between adjacent sleeves 278. Component 284 is adjustably connected to strap portion 272 such that the lengths of strap portion 272 may be adjusted to adjust the degree that compression mechanisms 230 and 232 compress internal storage volume 234 when strap portions 270 and 272 are connected together.

Figure 20:
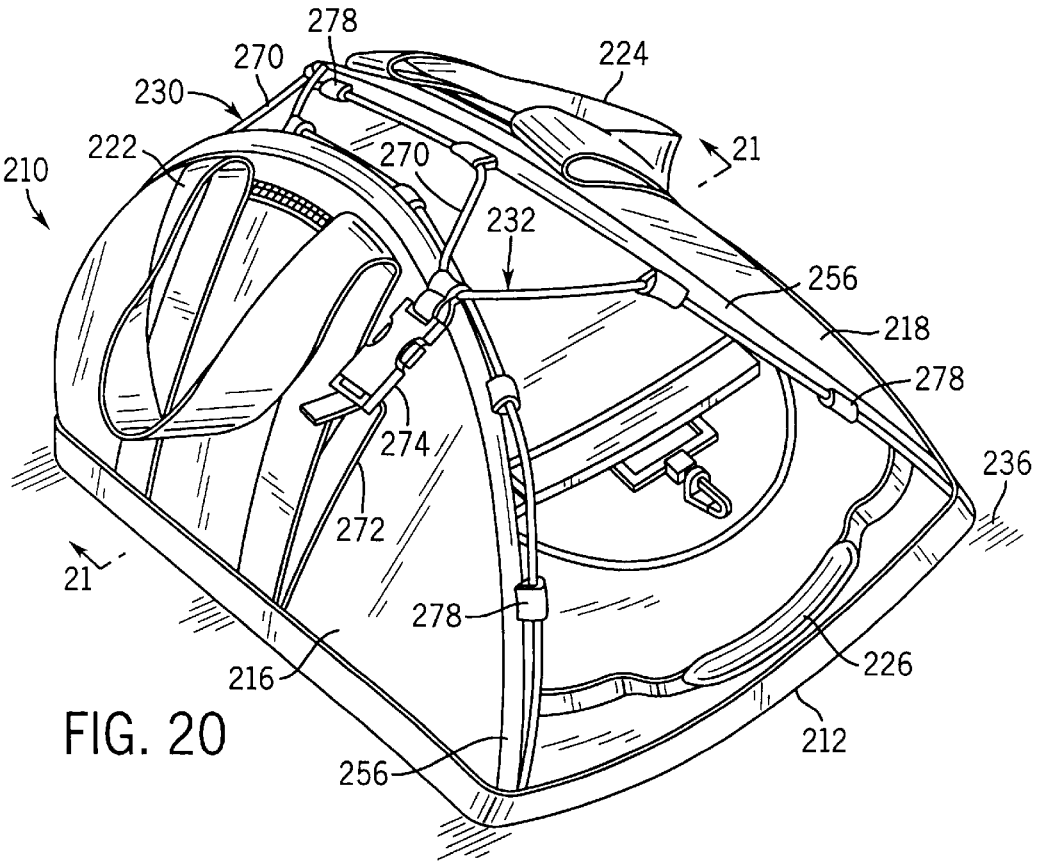
FIG. 20 is a top perspective view of the receptacle compression system of FIG. 16 in a compressed state.

FIGS. 16, 17, 20, and 21 best illustrate the use of compression mechanisms 230 and 232. As shown by FIGS. 16 and 17, disconnection of components 282 and 284 disconnects strap portions 270 and 272 and allows side panels 216 and 218 to be spread apart from one another to access opening 250 and closing mechanism 220. In this uncompressed state, receptacle 210 may be filled through opening 250 with various items. As best shown by FIGS. 20 and 21, receptacle 210 and its internal storage volume 234 are compressed by pulling strap portions 270 towards opposing strap portions 272 across opening 250 and connecting components 282 and 284 of connectors 274. Because strap portions 272 are secured proximate to bottom panel 212, strap portions 272, as well as side panels 216 and 218, are pulled across opening 250 and towards the junction of bottom panel 212 and the opposing side panel. As a result, the contents of internal storage volume 234 are symmetrically compressed towards the longitudinal center line of receptacle 210 extending between ends 238 and 240 and also towards bottom panel 212.

In addition to providing symmetrical compression of receptacle 210, compression mechanisms 230 and 232 also relieve stress as exerted upon closing mechanism 220. Because compression mechanisms 230 and 232 extend towards, and preferably across, opening 250, compression mechanisms 230 and 232 reduce tension within top panel 214 to further reduce stress applied to closing mechanism 220. Consequently, the useful life of closing mechanism 220 is prolonged. Moreover, opening 250 may be larger to provide accessibility to substantially the entire longitudinal length of receptacle 210 between ends 238 and 240 without substantially increasing the potential for failure of closing mechanism 220.

As further shown by FIG. 21, because side panels 216 and 218 have height extending from bottom panel 212 greater than the distance separating back panel 212 and top panel 214, panels 216 and 218 partially overlap top panel 214 upon compression of receptacle 210. As a result, panels 216 and 218 more effectively compress the contents contained within internal storage volume 234 towards bottom panel 212.

Figure 22:
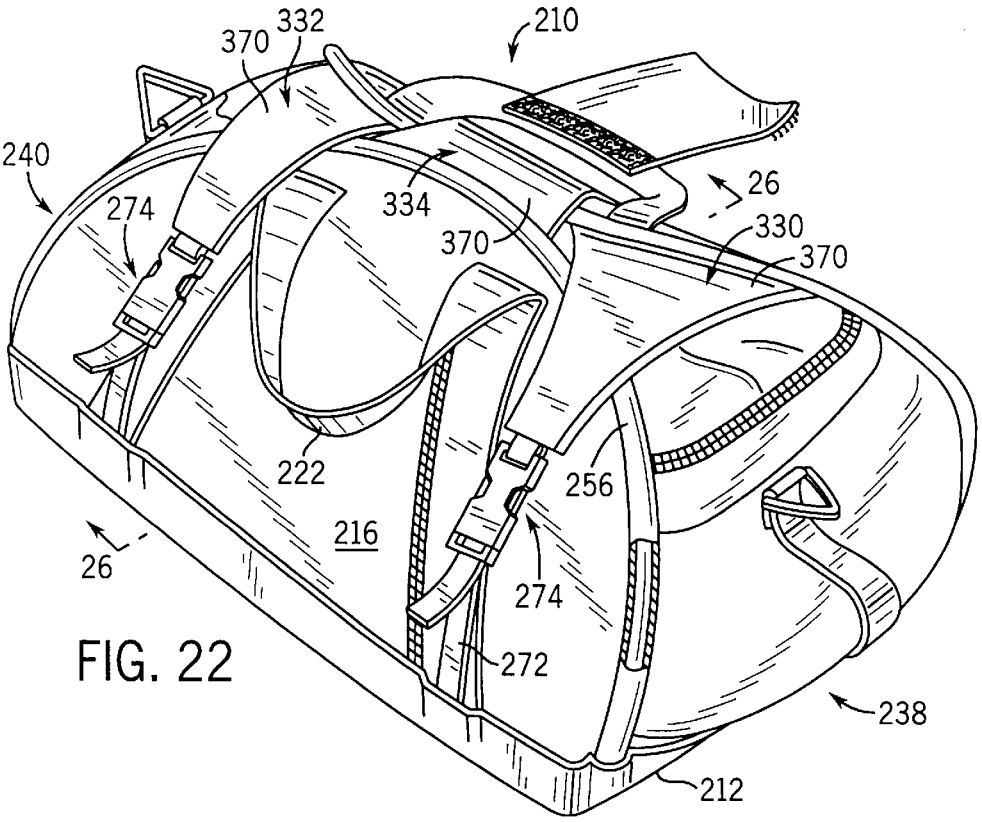
FIG. 22 is a top perspective view of another exemplary embodiment of the receptacle compression system of the present invention in a compressed state.

Another exemplary embodiment of receptacle 210 is best illustrated in FIGS. 22–27, wherein alternate compression mechanisms 330, 332, and 334 are employed. More specifically, the alternate embodiment includes two lateral compression mechanisms 330 and 332 and a middle compression mechanism 334. FIG. 22 illustrates compression mechanisms 330, 332, and 334 in an actuated state, compressing internal storage volume 234 of receptacle 210. Each of compression mechanisms 330, 332, and 334 preferably comprises tension members or straps that include strap portions 370 and 272 and connector 274. Strap portions 370 of compression mechanisms 330, 332, and 334 are wide-based tension members that narrow and elongate to terminate by coupling to connecting component 282 of connector 274.

In this embodiment, strap portions 370 of lateral compression mechanisms 330 and 332 are coupled to receptacle 210 proximate the junction of top panel 214 and side panel 218, whereas strap portion 370 of middle compression mechanism 334 is coupled to receptacle 210 proximate the junction of top panel 214 and side panel 216. In particular, strap portion 370 of lateral compression mechanism 330 is coupled to perimeter 256 of side panel 218 toward end 238. Similarly, strap portion 370 of lateral compression mechanism 332 is coupled to perimeter 256 of side panel 218 toward end 240. In contrast, strap portion 370 of middle compression mechanism 334 is coupled to perimeter 256 of side panel 216 intermediate between opposite ends 238 and 240 of receptacle 210. The wide-based section of strap portions 370 of compression mechanisms 330, 332, and 334 are preferably directly coupled to perimeters 256 of respective side panels 218 and 216 by stitching. Alternatively, strap portions 370 may be affixed to perimeters 256 of side panels 218 and 216 by other coupling means, such as, adhesives, fasteners, and the like. Furthermore, the wider-based, triangular-like configuration of strap portions 370 allow for greater surface area coverage of top panel 214 in general and of flap 252 in particular when compression mechanisms 330, 332, and 334 are in the actuated state, thereby facilitating more symmetrical compression of internal storage volume 234.

As previously described with reference to FIGS. 16–21, each strap portion 272 has an end affixed by stitching to side panels 216 and 218 near bottom panel 212. The second, opposite end of each strap portion 272 is secured to connecting component 284 of connector 274. Additionally, in this embodiment, one of strap portions 272 is located along side panel 216 towards end 238; a second of strap portions 272 is disposed along side panel 216 towards end 240; a third of strap portions 272 is configured along side panel 218 intermediate between opposite ends 238 and 240. Connectors 274 are coupled between strap portions 370 and corresponding strap portions 272 to releasably interconnect strap portions 370 and strap portions 270 for compressing internal storage volume 234. Each connector 274 includes interconnectable components 282 and 284 secured to strap portions 370 and 272, respectively. Component 284 on strap portion 370 is adjustably connected to strap portion 272 such that the lengths of strap portion 272 may be adjusted to the degree that compression mechanisms 330, 332, and 334 compress internal storage volume 234 when strap portions 370 and 272 are connected together via components 282 and 284, respectively, of connector 274.

Figure 23:
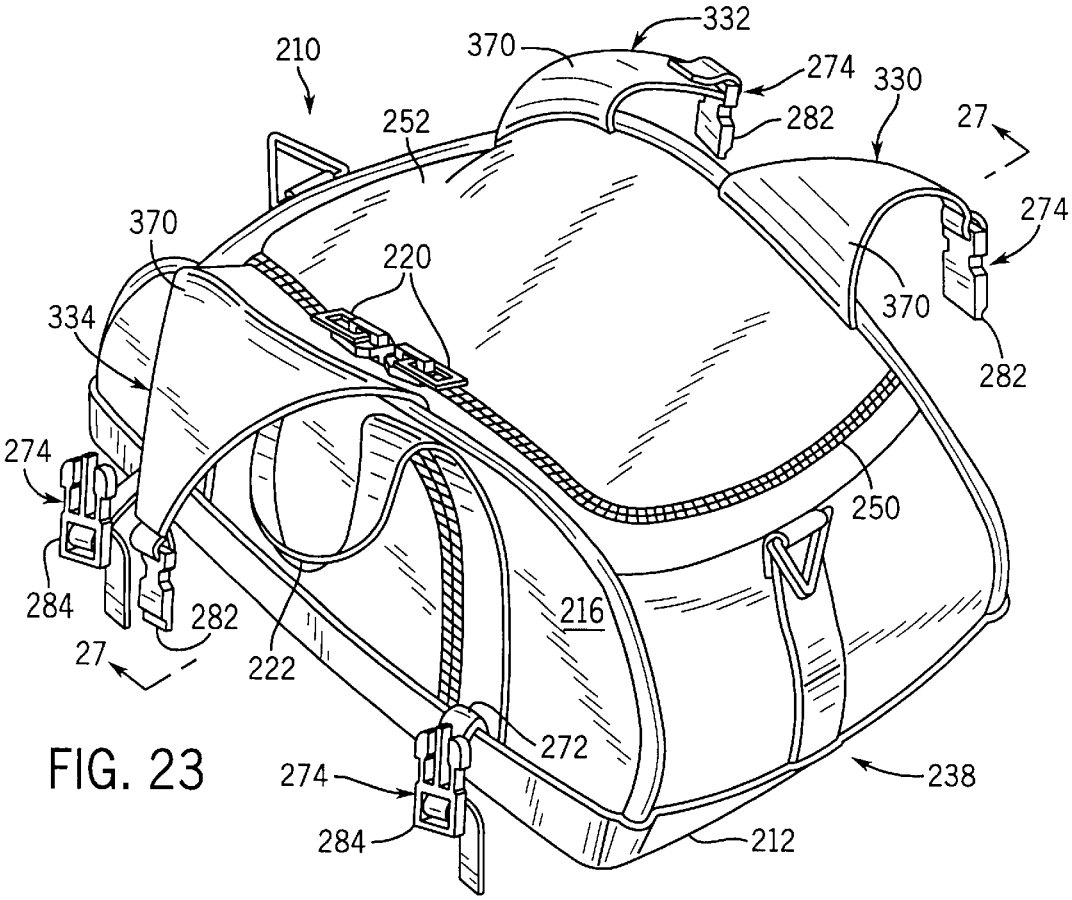
FIG. 23 is a top perspective view of the receptacle compression system of FIG. 22 in an uncompressed state.
Figure 24:
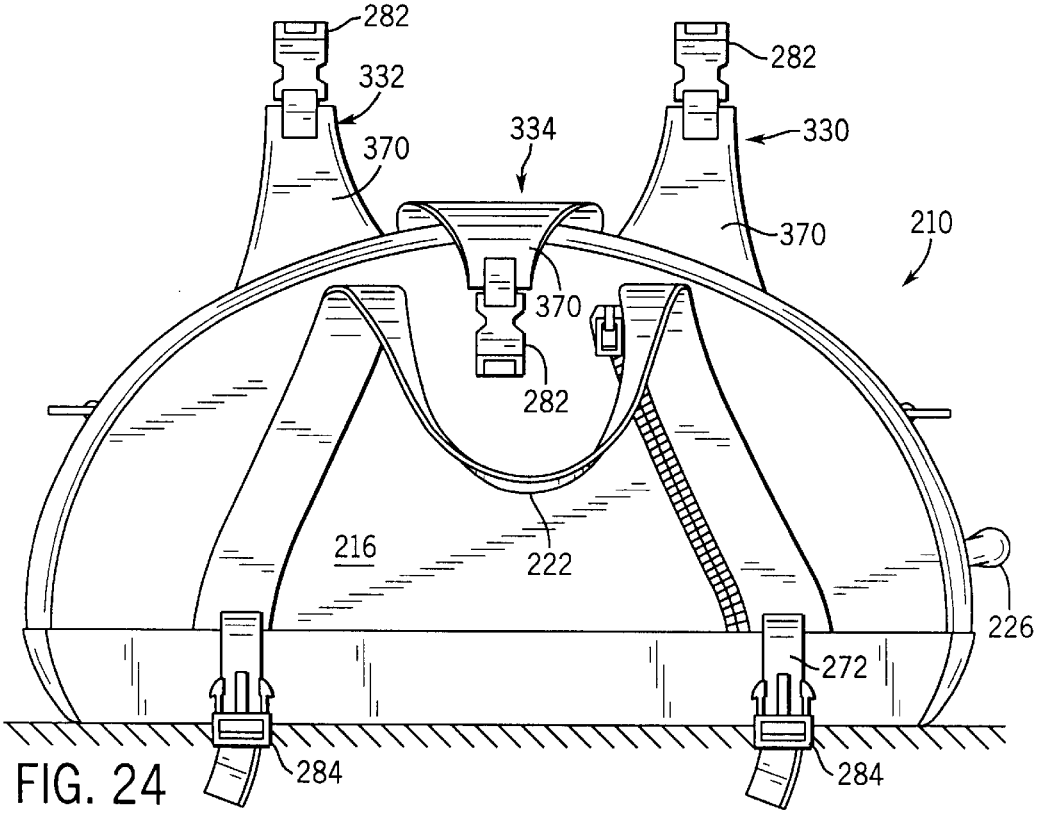
FIG. 24 is a side elevational view of the receptacle compression system of FIG. 22 in an uncompressed state.
Figure 25:
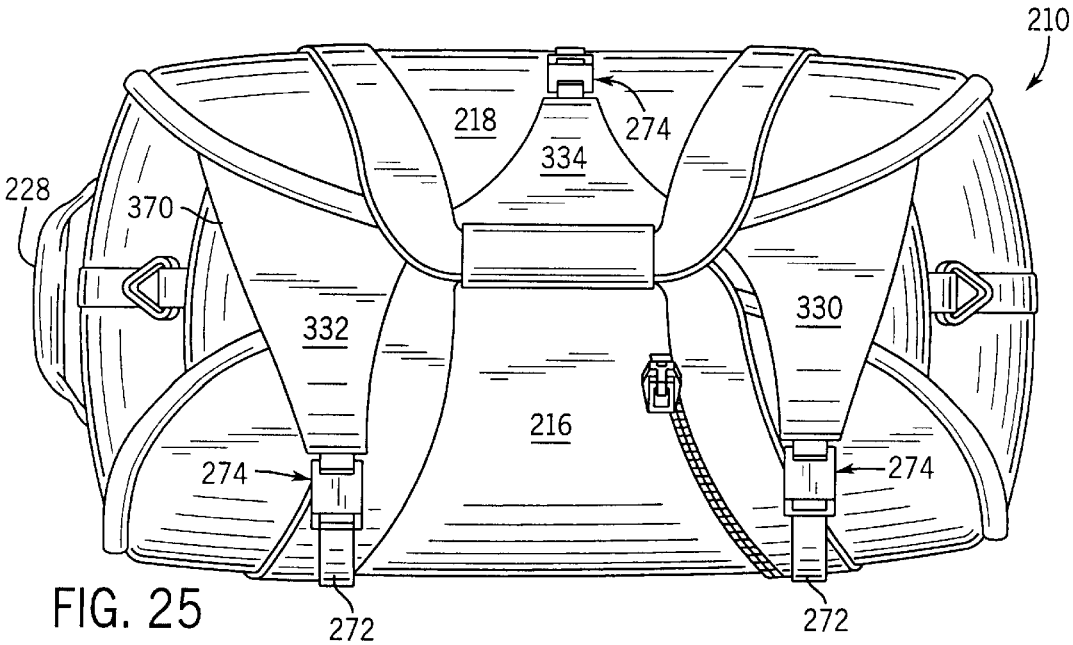
FIG. 25 is a top perspective view of the receptacle compression system of FIG. 22 in a compressed state.
Figure 26:
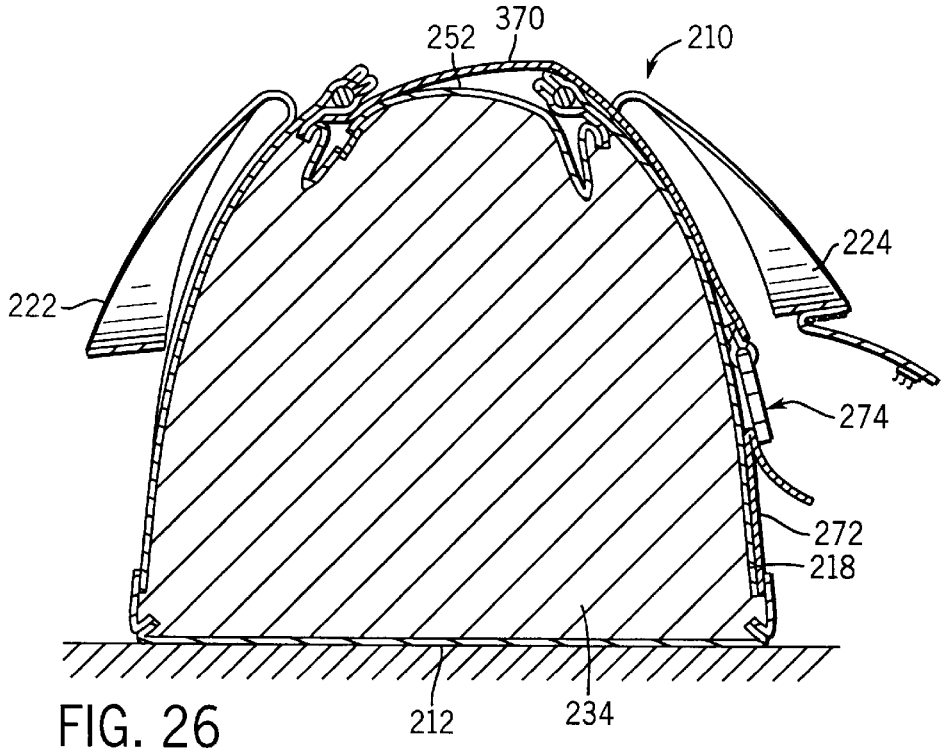
FIG. 26 is a sectional view of the receptacle compression system of FIG. 22 taken along lines 26—26.
Figure 27:
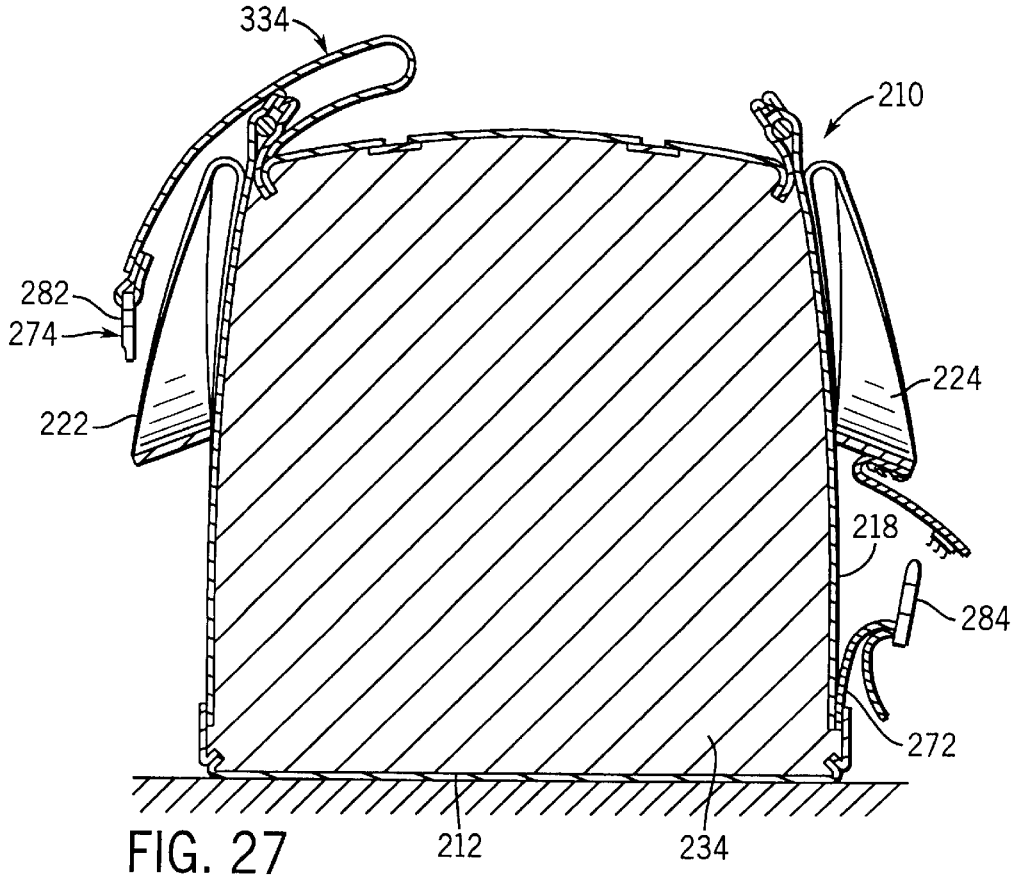
FIG. 27 is a sectional view of the receptacle compression system of FIG. 23 taken along lines 27—27.

FIGS. 22, 23, 26, and 27 best illustrate the use of compression mechanisms 330, 332, and 334. As shown by FIGS. 23 and 27, disconnection of components 282 and 284 disconnects corresponding strap portions 370 and 272 and allows side panels 216 and 218 to be spread apart from one another to access opening 250 and closing mechanism 220. As further shown by FIGS. 23 and 27, when side panels 216 and 218 are spread apart from one another, perimeters 256 (identified in FIG. 22) are in a separated position. In this uncompressed state, receptacle 210 may be filled through opening 250 with various articles. As best shown by FIGS. 22 and 26, receptacle 210 and its internal storage volume 234 are compressed by pulling strap portions 370 towards opposing strap portions 272 across opening 250 and then connecting components 282 and 284 of connectors 274. Because strap portions 272 are secured proximate to bottom panel 212, strap portions 272, as well as side panels 216 and 218, are pulled across opening 250 and towards the junction of bottom panel 212 and the opposing side panel. As further shown by FIGS. 22 and 26, side panels 216 and 21B and their perimeters 256 (identified in FIG. 22) are in a converging position (i.e., perimeters 256 extend in a general direction towards one another). Hence, when compression mechanisms 330, 332, and 334 are actuated, the contents of internal storage volume 234 are more symmetrically compressed towards the longitudinal center line of receptacle 210 between ends 238 and 240 towards bottom panel 212.

Such symmetrical compression by compression mechanisms 330, 332, and 334 of internal storage volume 234 also relieves the stress exerted upon closing mechanism 220. Moreover, because compression mechanisms 330, 332, and 334 extend across opening 250, covering most of the extent of opening 250, compression mechanisms 330, 332, and 334 reduce tension within top panel 214 to further lower the stress applied to closing mechanism 220. Further still, in addition to providing more symmetrical compression of receptacle 210 and to relieving the stress applied to closing mechanism 220, the wider-based configurations of strap portions 370 of compression mechanisms 330, 332, and 334 are also protective against the susceptibility of catching on a protruding surface of a baggage conveyor system. In this embodiment, compression mechanisms 330, 332, and 334 inhibit the potential for any torque-like twisting motion of receptacle 210, thereby protecting receptacle 210 and the articles contained in internal storage volume 234 from the risk of damage.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements. 1

What is claimed is:

1. A receptacle compression system comprising:

a receptacle enclosing an internal volume, the receptacle including a bottom panel having first and second opposite ends and first and second opposite sides, a top panel opposite the bottom panel, the top panel including an opening therethrough;

first and second side panels coupled to the first and second sides of the bottom panel, respectively, and extending towards the top panel, wherein the first and second side panels each have a rigid perimeter extending from the bottom panel;

a first compression strap connected to one of the first and second side panels and configured to extend across the opening to be connected to the other of the first and second side panels, wherein the first compression strap has a first end connected adjacent to the top panel and the first side panel and a second end connected adjacent to the bottom panel and the second side panel.

2. The system of claim 1, wherein the second compression strap has a first end connected adjacent to the top panel and the second side panel and a second end connected adjacent to the bottom panel and the first side panel.

3. The system of claim 1, wherein the second compression strap has a first end connected adjacent to the top panel and the first side panel and a second end connected adjacent to the bottom panel and the second side panel.

4. The system of claim 3, including a third compression strap having a first end connected adjacent to the top panel and the second side panel and a second end connected adjacent to the bottom panel and the first side panel.

5. The system of claim 1, wherein the first and second side panels define the internal storage volume.

6. The system of claim 1, wherein the first and second panels include a rigid mechanism extending along the perimeter.

7. The system of claim 1, wherein the first and second side panels each arcuately extend from the bottom panel.

8. The system of claim 1, wherein the first and second compression straps are coupled to the first and second panels at a plurality of locations along the perimeter of each side panel.

9. The system of claim 1, wherein the top panel is separated from the bottom panel by a first distance and wherein the first and second side panels extend from the bottom panel by second greater distance such that the first and second side panels partially overlap the top panel upon compression of the internal volume.

10. The system of claim 1, wherein the first and second compression straps overlap one another.

11. The system of claim 1, including first and second handles coupled to the first and second side panels, respectively.

12. The system of claim 1, including a handle between the first and second side panels proximate one of the first and second opposite ends.

13. The system of claim 1, wherein at least one of the first and second compression straps has an adjustable length.

14. The system of claim 1, wherein the first compression strap includes:

a first portion coupled to the first side;

a second portion coupled to the second side; and a connector configured to releasably connect the first and second portions.

15. The system of claim 14, wherein the connector comprises a quick disconnect buckle.

16. The system of claim 1, including at least two spaced sleeves along the perimeter of the first side panel, wherein the first compression strap extends through the at least two sleeves.

17. The system of claim 1, wherein the rigid perimeter of the first side panel and the rigid perimeter of the second side panel are movable from a first separated position which are movable between a first separated position and a second converging position.

18. The system of claim 17, wherein the rigid perimeter of the first side and the rigid perimeter of the second side panel flex between the separated positioned and the converging position.

19. A receptacle compression system comprising:

a receptacle enclosing an internal volume including a bottom panel having first and second opposite ends and first and second opposite sides, a top panel opposite the bottom panel, the receptacle including an opening to access the internal volume;

a first panel extending between the first and second opposite ends along a first side of the internal volume, the first panel being coupled proximate to the bottom panel at the first side and extending towards the top panel, the first panel having a first perimeter;

a second panel extending between the first and second opposite ends along a second side of the internal volume, the second panel being coupled proximate to the bottom panel at the second side and extending towards the top panel, the second panel having a second perimeter;

a first compression mechanism coupled to one of the first perimeter and the second perimeter and configured to be releasably coupled to the receptacle proximate one of the second side and the first side, respectively, of the bottom panel to compress the first panel over the internal volume and towards the other of the first and second side, respectively, of the internal volume; and a second compression mechanism coupled to one of the first perimeter and the second perimeter and configured to be releasably coupled to the receptacle proximate one of the second side and the first side, respectively, of the bottom panel to compress the second panel over the internal volume and towards the other of the first and second side, respectively, of the internal volume, wherein the top panel includes the opening, wherein the opening longitudinally extends between the first and second ends, and wherein the first and second panels extend across the opening while compressing the internal volume of the receptacle.

20. The system of claim 19, wherein the top panel includes the opening, wherein the opening longitudinally extends between the first and second ends, and wherein the first and second compression mechanisms extends across the opening while compressing the internal volume of the receptacle.

21. The system of claim 19, including first and second handles coupled to the first and second panels, respectively.

22. The system of claim 19, wherein the first and second panels extend beyond the top panel.

23. The system of claim 19, wherein the first and second panels define the internal volume.

24. The system of claim 19, wherein at least one of the first and second compression straps has an adjustable length.

25. The system of claim 19, including a handle between the first and second panels proximate to one of the first and second ends.

26. The system of claim 19, wherein the first compression mechanism is coupled to the first perimeter and is configured to be releasably coupled to the receptacle proximate the second side of the bottom panel and wherein the second compression mechanism is coupled to the first perimeter and is configured to be releasably coupled to the receptacle proximate the second side of the bottom panel.

27. The system of claim 26, including a third compression mechanism coupled to the second perimeter and configured to be releasably coupled to the receptacle proximate the first side of the bottom panel.

28. The system of claim 19, wherein the first compression mechanism is coupled to the first perimeter and is configured to be releasably coupled to the receptacle proximate the second side of the bottom panel and wherein the second compression mechanism is coupled to the second perimeter and is configured to be releasbly coupled to the receptacle proximate the first side of the bottom panel.

29. A receptacle compression system comprising:

a receptacle enclosing an internal volume, the receptacle including:

a bottom panel;

first and second side panels extending from first and second opposite sides of the bottom panel, wherein the first and second side panels each have arcuate perimeters extending from a location proximate the bottom panel; and a top panel extending between the first and second side panels, the top panel including an opening therethrough, wherein the bottom panel, first and second side panels and the top panel define an internal volume therebetween which is accessed through the opening in the top panel; and a first compression strap having a first end portion adhered to the receptacle on a first side of the internal volume and a second end portion connected to the receptacle on a second side of the internal volume, wherein the first strap extends across the opening in the top panel and compresses the first side panel towards the second side panel.

30. The system of claim 29, wherein the first compression strap has an adjustable length.

31. The system of claim 30, wherein the first end portion and the second end portion are releasably connected to one another.

32. The system of claim 31, wherein the first end portion and the second end portion are releasably connected to one another by a quick disconnect buckle.

33. The system of claim 32, wherein the first and second side panels each include a rigid member extending along the arcuate perimeter.

34. The system of claim 33, wherein the arcuate perimeters of the first and second side panels each include a sleeve and wherein the rigid member comprises a delrin rod received within the sleeve.

35. The system of claim 29 including a second compression strap having a third end portion connected to the receptacle on the first side of the internal storage cavity and a second end portion connected to the receptacle on a second side of the internal storage cavity, wherein the second compression strap extends across the opening in the top panel.

36. The system of claim 29, wherein the receptacle includes a zipper mechanism adjacent the opening to selectively open and close the opening.

37. A receptacle compression system comprising:

a receptacle enclosing an internal volume, the receptacle including:

a bottom panel having a first major longitudinal dimension and a second minor transverse dimension;

first and second side panels extending from first and second opposite longitudional sides of the bottom panel, wherein the first and second side panels each have arcuate perimeters, wherein the arcuate perimeters of the first and second side panels include a rigid member extending therealong; and a top panel extending between the first and second side panels, the top panel including an opening therethrough, wherein the bottom panel, first and second side panels and the top panel define an internal volume therebetween which is accessed through the opening in the top panel.

38. The system of claim 37, wherein the arcuate perimeters each include a sleeve and wherein the rigid member comprises a delrin rod received within the sleeve.

39. The system of claim 37, including at least one compression strap, each compression strap including a first end portion coupled to the receptacle on a first side of the internal storage compartment and a second end portion connected to the receptacle on a second side of the internal storage compartment, wherein each compression strap extends across the opening in the top panel.

40. A receptacle compression system comprising:

a receptacle enclosing an internal volume including a bottom panel having first and second opposite ends and first and second opposite sides, a top panel opposite the bottom panel, the receptacle including an opening to access the internal volume;

a first panel extending between the first and second opposite ends along a first side of the internal volume, the first panel being coupled proximate to the bottom panel at the first side and extending towards the top panel, the first panel having the first perimeter;

a second panel extending between the first and second opposite ends along a second side of the internal volume, the second panel being coupled proximate to the bottom panel at the second side and extending towards the top panel, the second panel having a second perimeter;

a first compression mechanism coupled to one of the first perimeter and the second perimeter and configured to be releasably coupled to the receptacle proximate one of the second side and the first side, respectively, of the bottom panel to compress the first panel over the internal volume and towards the other of the first and second side, respectively, of the internal volume; and a second compression mechanism coupled to one of the first perimeter and the second perimeter and configured to be releasably coupled to the receptacle proximate one of the second side and the first side, respectively, of the bottom panel to compress the second panel over the internal volume and towards the other of the first and second side, respectively, of the internal volume, wherein the first compression mechanism is coupled to the first perimeter and is configured to be releasably coupled to the receptacle proximate the second side of the bottom panel and wherein the second compression mechanism is coupled to the first perimeter and is configured to be releasably coupled to the receptacle proximate the second side of the bottom panel.

41. A receptacle compression system comprising:

a receptacle enclosing an internal volume, the receptacle including a bottom panel having first and second opposite ends and first and second opposite sides, a top panel opposite the bottom panel, the top panel including an opening therethrough;

first and second side panels coupled to the first and second sides of the bottom panel, respectively, and extending towards the top panel, wherein the first and second side panels include a first rigid perimeter and a second rigid perimeter, respectively, extending from the bottom panel;

a first compression mechanism connected to one of the first and second side panels and configured to extend across the opening to be connected to the other of the first and second side panels; and a second compression mechanism connected to one of the first and second side panels and configured to extend across the opening to be connected to the other of the first and second side panels, wherein the rigid perimeter of the first side panel and the rigid perimeter of the second side panel are movable from a first separated position to a second converging position to compress the interior volume of the receptacle.

42. The system of claim 41, wherein the first and second side panels each have arcuate perimeters extending from a location proximate the bottom panel.

* * * * *